United States Patent [19]

Greek, Jr. et al.

[11] 3,952,852

[45] Apr. 27, 1976

[54] COLUMN FORMAT CONTROL SYSTEM

[75] Inventors: John Charlie Greek, Jr.; Michael Eudell McBride; Howard Carl Tanner, all of Austin, Tex.

[73] Assignee: International Business Machines Corporation, Armonk, N.Y.

[22] Filed: Jan. 22, 1975

[21] Appl. No.: 543,090

[52] U.S. Cl. ..... 197/19; 197/84 A; 197/176; 340/172.5

[51] Int. Cl.[2] ..... B41J 21/00

[58] Field of Search ..... 197/19, 20, 176, 180, 197/84 A, 84 R; 340/172.5

[56] References Cited

UNITED STATES PATENTS

| | | | |
|---|---|---|---|
| 3,529,296 | 9/1970 | Friedman et al. | 197/19 |
| 3,675,216 | 7/1972 | James | 340/172.5 |
| 3,755,784 | 8/1973 | Greek, Jr. et al. | 340/172.5 |
| 3,814,011 | 6/1974 | Kashio | 101/93.15 |
| 3,832,697 | 8/1974 | Kashio | 197/176 |
| 3,844,397 | 10/1974 | Richards | 197/19 |
| 3,850,270 | 11/1974 | Kolpek | 197/19 |
| 3,885,663 | 5/1975 | Suzuki | 197/19 |

*Primary Examiner*—Edgar S. Burr
*Assistant Examiner*—William Pieprz
*Attorney, Agent, or Firm*—James H. Barksdale, Jr.

[57] ABSTRACT

A system for printing a plurality of sequentially stored text columns in a side-by-side format. Corresponding lines from each column are printed out on a print line in operator defined locations. After a line from one of the columns is printed on a print line, the carrier caused to escape, and any corresponding lines from succeeding columns are printed on the same line prior to causing a printer carrier return.

11 Claims, 21 Drawing Figures

MEM. RTN.
PLAYBACK
KB STROBE
CR
TAB
RDY
KB DATA
ESC. MAG.
KB STROBE
PRT FB
SR DATA BUSS
DECODE
CR
TAB
CM
CHAR
BOM
EOM
FLAG
CB
CE
SPACE
EOM
SR INPUT
SR CONTROL UNIT
SR STORAGE
CLOCK
INSERT
OUTPUT FORMAT CONTROL
46
MEM RTN
PLAYBACK
SCAN
JUSTIFY
FLUSH LEFT
MEASURE
MULTICOLUMN CONTROL LOGIC & PLAYOUT CONTROL
45
MCS INSERT
TRAP
RST SCAN
PRINT MAGS
DECODE
CLOCK

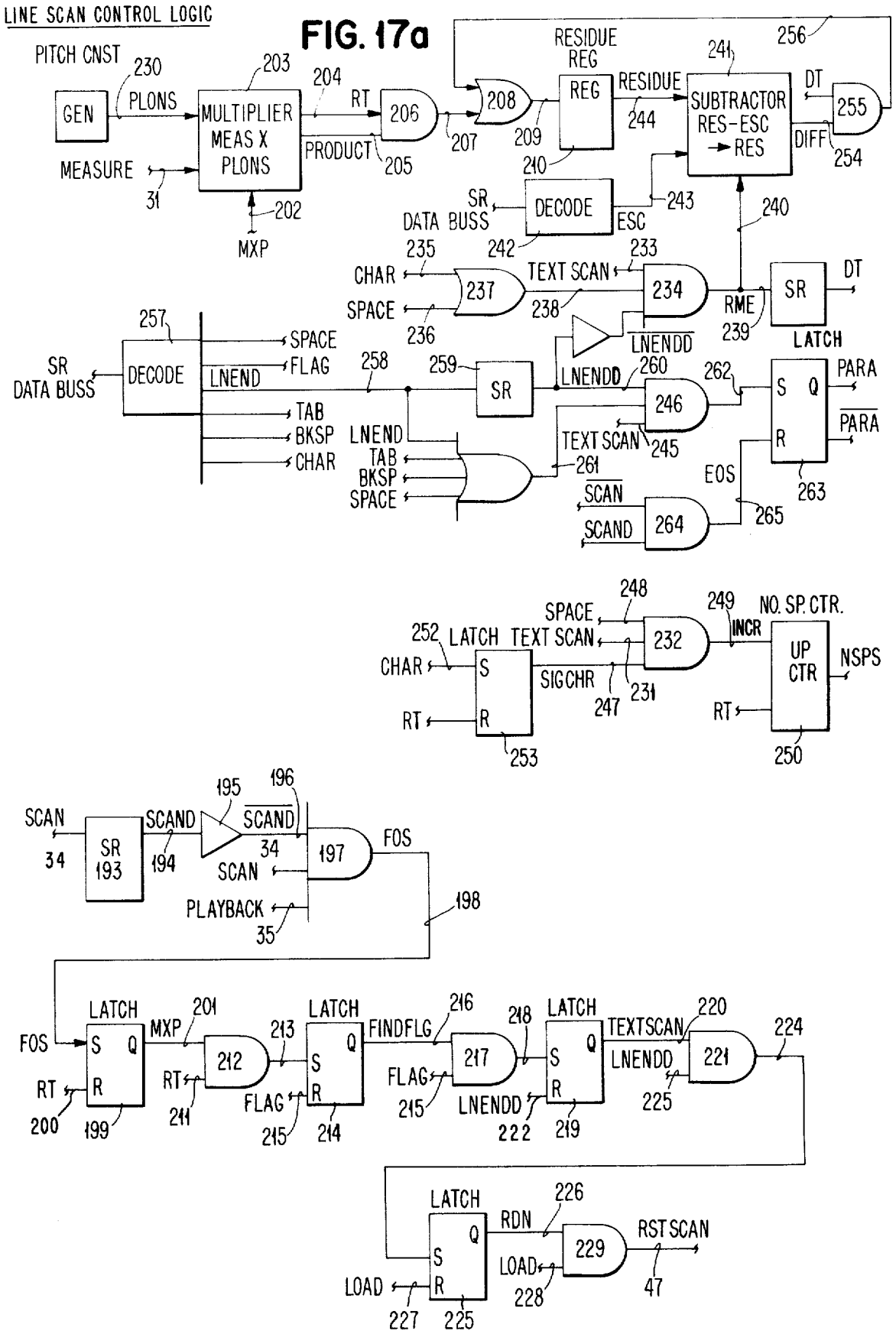
LINE SCAN CONTROL LOGIC
FIG. 17a
PITCH CNST
230
GEN
PLONS
MEASURE
31
203
MULTIPLIER
MEAS X
PLONS
202
MXP
204
RT
PRODUCT
205
206
207
208
209
RESIDUE
REG
REG
210
RESIDUE
244
241
SUBTRACTOR
RES-ESC
→RES
DT
DIFF
255
254
256
SR
DATA BUSS
DECODE
242
ESC
243
240
CHAR
235
237
SPACE
236
TEXT SCAN
233
238
234
RME
239
SR
LATCH
DT
257
DECODE
SR
DATA BUSS
SPACE
FLAG
LNEND
TAB
BKSP
CHAR
258
259
SR
LNENDD
260
LNENDD
246
262
S
Q
R
PARA
PARA
TEXT SCAN
245
LNEND
TAB
BKSP
SPACE
261
SCAN
SCAND
264
EOS
265
263
248
SPACE
TEXT SCAN
232
249
INCR
NO. SP. CTR.
UP
CTR
NSPS
RT
250
252
LATCH
CHAR
S
R
RT
253
SIGCHR
247
231
SCAN
34
SR
193
194
SCAND
195
196
SCAND
34
SCAN
197
FOS
PLAYBACK
35
198
FOS
LATCH
S
Q
R
RT
200
199
MXP
201
RT
211
212
213
LATCH
S
Q
R
FLAG
215
214
FINDFLG
216
FLAG
215
217
218
LNENDD
222
LATCH
S
Q
R
219
TEXTSCAN
220
LNENDD
225
221
224
LATCH
S
Q
R
LOAD
227
225
RDN
226
LOAD
228
229
RST SCAN
47

SPACE SIZE CALCULATION LOGIC

PRINTER ESCAPEMENT CONTROL LOGIC

SCAN TIMING

PRINTER ESCAPEMENT CONTROL TIMING

COLUMN FORMAT CONTROL SYSTEM

BACKGROUND OF THE INVENTION

1. Field of the Invention

This invention generally relates to printing systems which print out text stored in a buffer. More specifically, this invention relates to a system for controlling the output printing of columns which have been stored in a buffer sequentially.

2. Description of the Prior Art

Representative of the closest known prior art are U.S. Pat. Nos. 3,351,917; 3,512,623; 3,739,344; 3,577,127; 3,609,699; and IBM Technical Disclosure Bulletin Vol. 9, No. 11, April 1967, pages 1575–1577. The first three listed patents were developed during a search of unexpired U.S. patents in the Patent Office. Although none of the cited patents is considered pertinent to the subject invention, U.S. Pat. No. 3,739,344 does disclose a printing system for aligning numbers against a tab stop. The carrier is caused to escape to the desired tab stop, and for each number keyed, the carrier is backspaced a distance equivalent to the escapement for the keyed number.

In the past there have been a number of ways of handling columns which have been stored sequentially and which are to be printed out in a side-by-side format. Generally this has been accomplished by defining the field in which each column is to be printed, printing a column in its entirety, and then reverse indexing and tabbing to the beginning of the next column to be printed. Not only has this been time consuming, but elaborate indexing and tabbing structure has been required. This is particularly the case when there is a difference in the length of each column. A need then arises for determining the extent of indexing to the beginning of the next column for printing. Another example of prior art handling of columnar printout is illustrated in the referred IBM TDB. Here the columns are keyed as they will be printed out. This can be disconcerting to the operator even in the absence of the required elaborate coding. The above problems are overcome with the subject system through marking the columns during input keying for storage and then controlling printout dependent upon the marking. In this way corresponding lines of each column are printed out on a print line automatically and sequentially prior to causing a printer carrier return.

SUMMARY OF THE INVENTION

A system is provided having basically a keyboard and printer, a buffer and control, and a multi-column playout control unit. During setup for input keying, a beginning of memory code is stored, the mode to be used first is stored, and an overall measure is stored in the buffer. Also, since the input printer is the same as the output printer, a tab field is set up for defining the locations in which the columns are to be located. For columns which are to be stored sequentially, but printed out in a side-by-side manner, the beginning of each column is defined by a column begin code. For the first column, this code is stored along with the column mode and measure. If subsequent columns have different modes or measures, they will be stored along with the columns concerned. Each column is then keyed and stored in its entirety. At the end of the last column to be printed out in side-by-side relationship, a column end code is keyed and stored. Upon playout from the buffer, the buffer memory is scanned when a column begin code is encountered. An operation flag is inserted into the data flow making up the buffer memory after the first column begin code. After each column begin code except the first, a column marker code is inserted and scan continues. Upon detection of the column end code, scanning continues to the beginning of memory. When the operation flag is again detected, following characters and spaces are printed out in the defined mode until a carrier return is detected. The printer is caused to tab rather than to return the carrier to the left margin. A column advance operation is then performed. This causes a column marker code to be written over the operation flag, and a scan of memory. The next detected column marker code is written over with a new operation flag. Printout then continues until a carrier return is detected. The operation described continues with column advance operations until the end of each column is reached. After printout of all columns, the column marker codes are flushed from memory.

BRIEF DESCRIPTION OF THE DRAWING

FIGS. 17 *d* and *e* are timing diagrams illustrating the timing of the operations performed by the structure shown in FIGS. 17 *a–c*.

DESCRIPTION OF THE PREFERRED EMBODIMENT

Operations to be Performed

Figure 1:
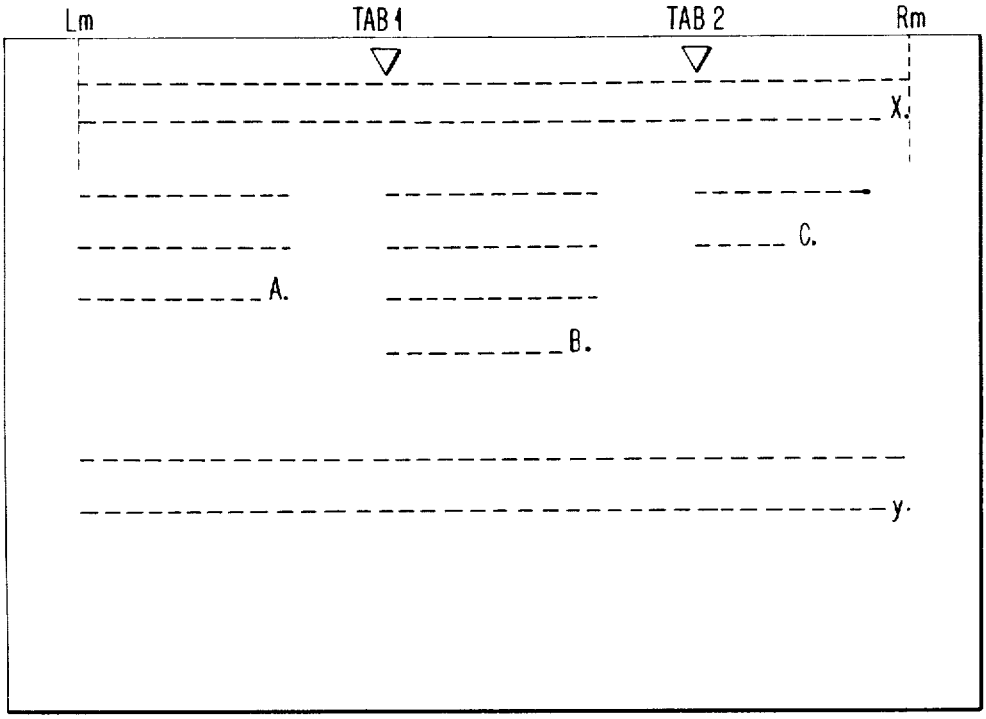
FIG. 1 is a pictorial representation of a desired output format with columns of text aligned side-by-side.

For a more detailed description of the invention, reference will first be made to those figures of the drawing which illustrate the operations to be performed in terms of both memory arrangement and printout. Referring first to FIG. 1, there is shown the desired output format. The left and right margins have been set as well as two tab positions, tab 1 and tab 2. The first two lines as well as the last two lines are shown justified between the left and right margins. Intermediate to these two sets of lines are three columns of varying length. The left column contains three lines which are to be justified with the left margin for the entire sheet also serving as the left margin for the column. The center column contains four lines which are to be justified with the left margin being the tab 1 position. The right column contains two lines in a flush left format. The left margin for this third column is the tab 2 position.

The dashes represent characters and spaces. X and Y represent the last characters of the above referred to two sets of lines. A, B, and C represent the last characters in each of the columns.

Figure 2:
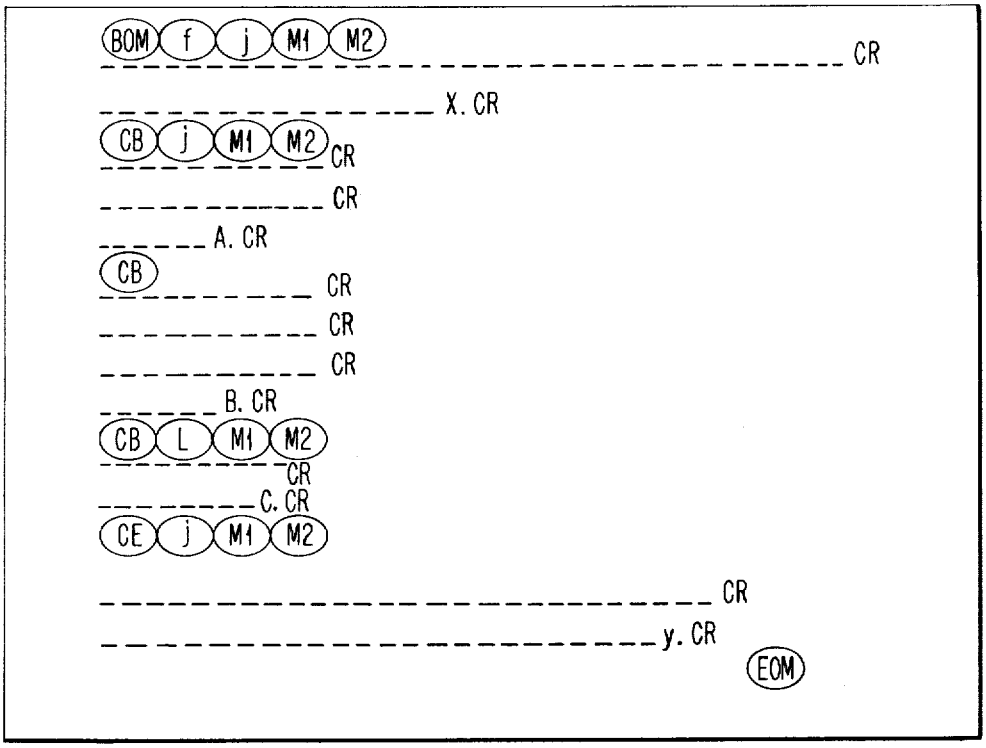
FIG. 2 is a pictorial representation of both a memory and keying format for obtaining the desired format shown in FIG. 1 upon playout.

Refer next to FIG. 2. In this figure is shown the keying sequence performed by the operator during input keying. This same keying sequence is representative of the serial format which will be stored in memory. That is, when stored in memory this format will be a serial stream of data and control codes. It is to be pointed out that printing during input keying will not exactly correspond to the pictorial representation of memory shown in FIG. 2. This is because the beginning of memory, flag, justify, measure pair, column begin, column end, and end of memory codes will be stored in memory but not printed. It is also to be pointed out that since the same input/output device is used for input keying, printing and storage as will be used for output printing, the operator will set the left and right margins and the tab positions as shown in FIG. 1. During input keying and storage the tab positions are not of particular importance other than the fact that the operator must not key more text than will ultimately fit within the boundries thus established, upon playout. As far as this application is concerned, it is to be assumed that the system contains a page buffer with the beginning of the page being marked by a beginning of memory code and the end of the page being marked by an end of memory code. During input keying, the operator can key the beginning of memory code or it can be input into memory by the system. In any event, this is considered to be no part of this application or invention. The operation flag code shown between the beginning of memory and justify code is the operating point and will be addressing the next character or code in memory at any particular time. The justify code or format code is input by operator keying. The same is the case with the measure pair M1 and M2 for setting the left and right margins. With the mode and measure defined, the operator will begin keying text from the left margin and when the right margin is approached and an acceptable line ending is reached, a carrier return will be keyed. The carrier will be returned to the left margin. The platen of the printer will then be indexed and the second line will be keyed followed by a carrier return. The mode measure pair preceding these first two lines establishes the mode and measure for these two lines and will continue in effect in the absence of subsequent mode and measure pairs. As pictorially represented in FIG. 2 following the first two lines, three columns have been keyed and stored. The first two of these columns as pointed out with reference to FIG. 1 are to be justified and as can be seen are to have the same measure. Therefore, the operator will key a column begin code, a justify code, and a pair of measure code. Thereafter, the text for the first column will be keyed. Since the second column is to have the same mode and measure, only a column begin code is keyed and followed by text.

Since the third column is to have a different format and measure, following the column begin code a flush left mode code is keyed followed by the measure pair. Then the text is keyed. Since the last two lines are to be justified between the left and right margins, and the previous three columns are to be aligned side-by-side, a column end code is keyed followed by a justify code, a mode code, and a measure pair. Thereafter, the text for the last two lines is keyed and an end of memory code is stored by either the system or operator keying.

Figure 3:
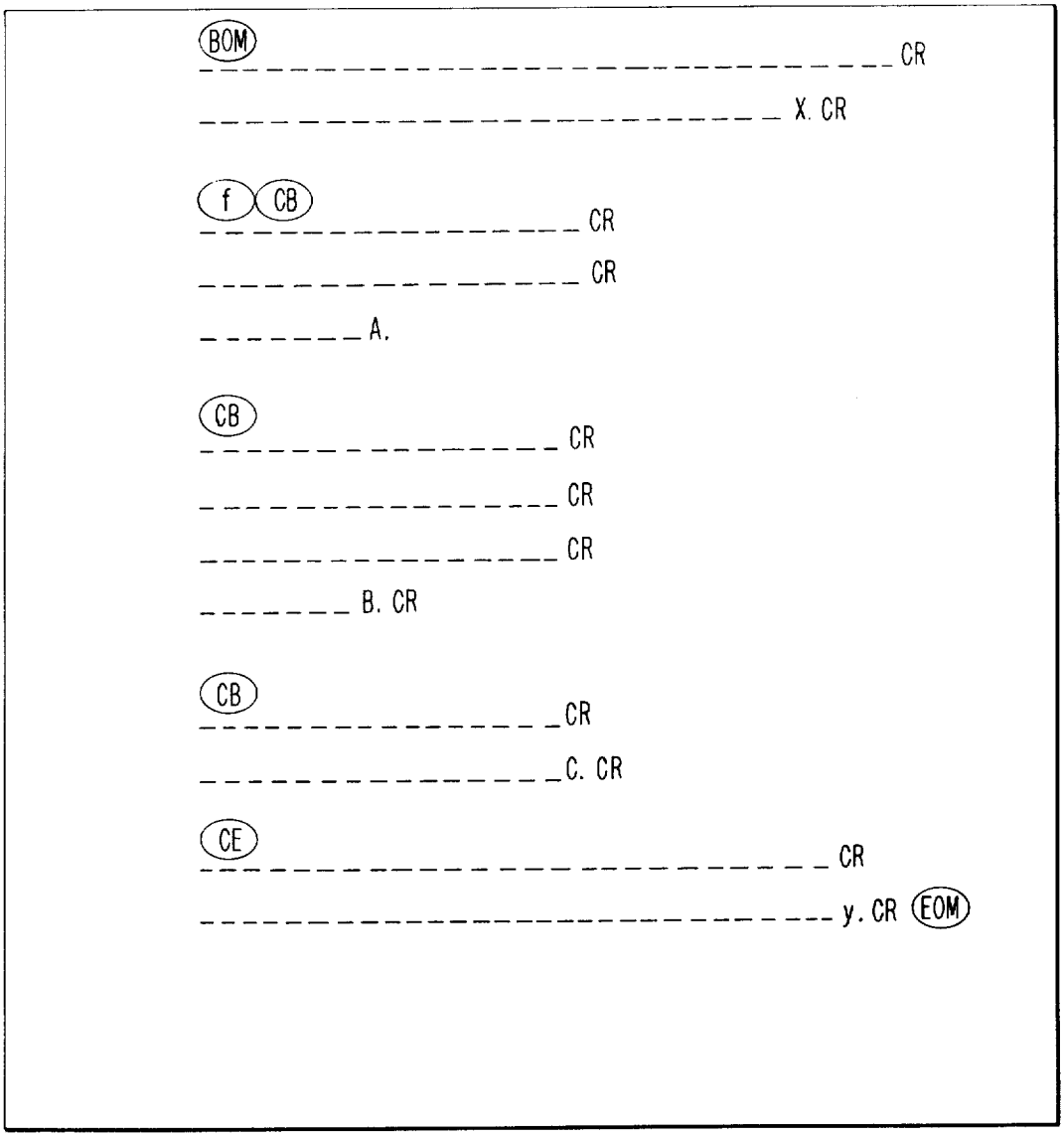
FIG. 3 is a pictorial representation of the memory prior to a scan for insertion of column marker codes.
Figure 4:
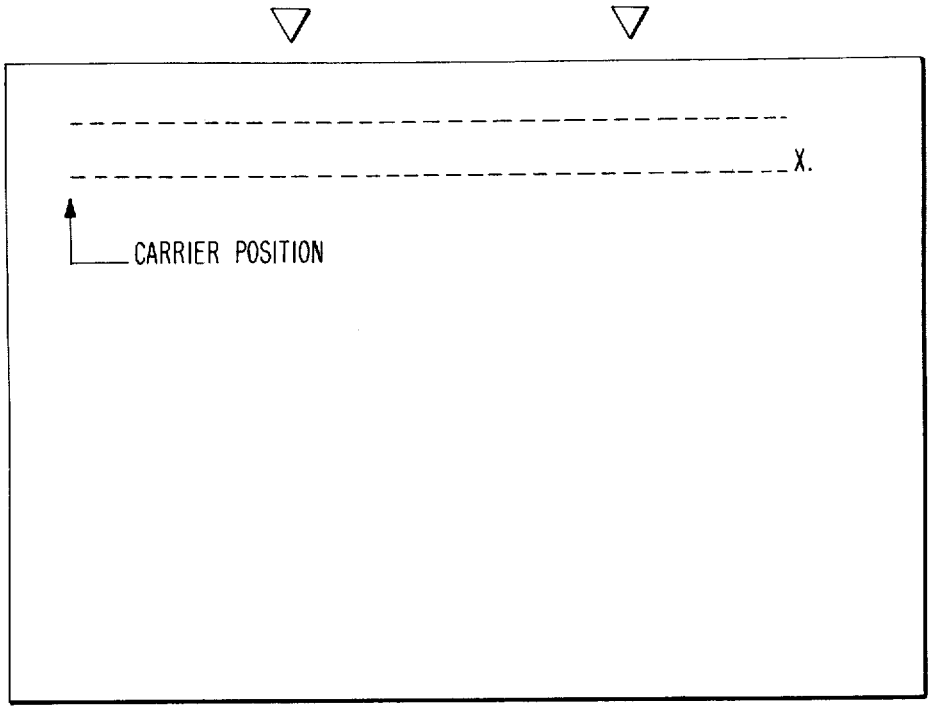
FIG. 4 is a pictorial representation of a playout of the first two lines of the memory in FIG. 3.

Refer next to FIG. 3. This figure is a pictorial representation of the memory prior to the beginning of printout of the first column. It is noted that the operation flag is addressing the first column begin code which defines the beginning of the first column. At this time, the carrier will be positioned at the left margin with the first two lines already having been printed in a justified format as illustrated in FIG. 4. FIG. 4 is a pictorial representation of the printed page printed from the memory illustrated in FIG. 3.

Figure 5:
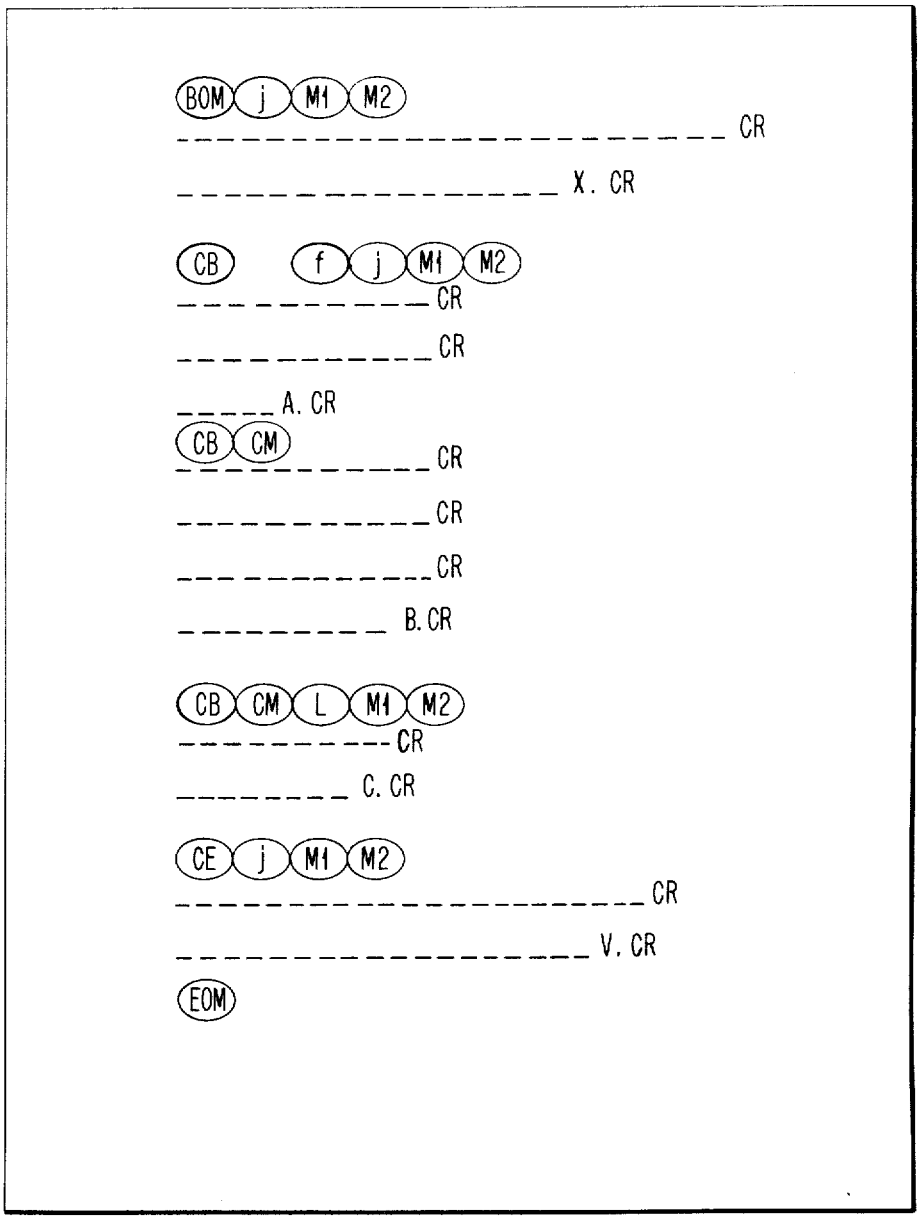
FIG. 5 is a pictorial representation of the memory after the first column begin code has been detected and before playout of the first column of text.

With the memory corresponding to FIG. 3 and the printed page and carrier position corresponding to that illustrated in FIG. 4, a scan operation is performed and column marker codes are inserted in the memory following each column begin code except the first. The operation flag is advanced past the first column begin code. This is illustrated in FIG. 5 with the flag addressing the first mode code. Therefore, FIG. 5 is a pictorial representation of the memory arrangement with the carrier positioned at the left margin and ready for printing the first column. Column marker codes have been inserted following the the first column. Column marker codes have been inserted following the column begin codes.

Figure 6:
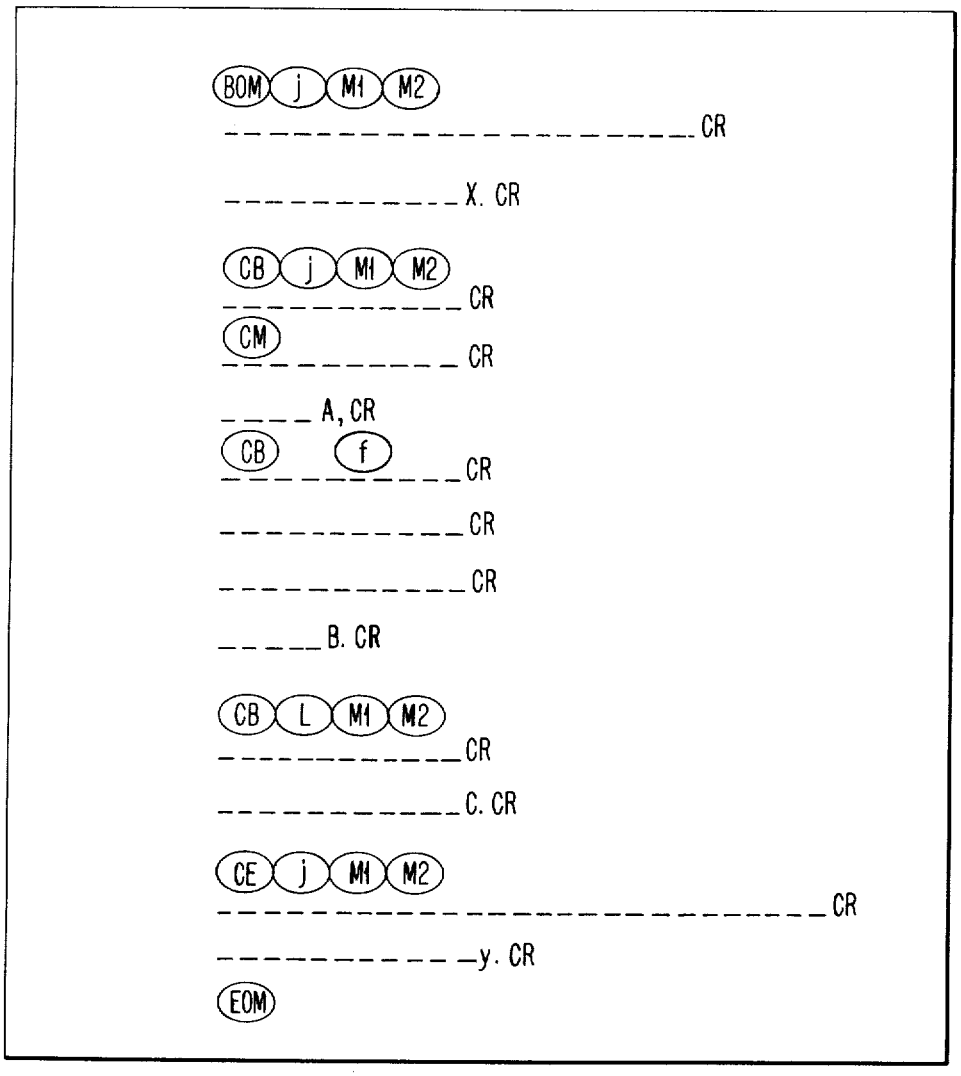
FIG. 6 is a pictorial representation of the memory after playout of the first line of the first column of text.

Referring next to FIG. 6 there is shown a pictorial representation of the memory arrangement following playout of the first line of the first column. It is to be noted that a column marker code has been written over the operation flag at the end of the first line and beginning of the second line of the first column. A column advance has been performed and the next column marker code has been written over with a new operation flag. Printout will now continue from the first line of the second column.

Figure 7:
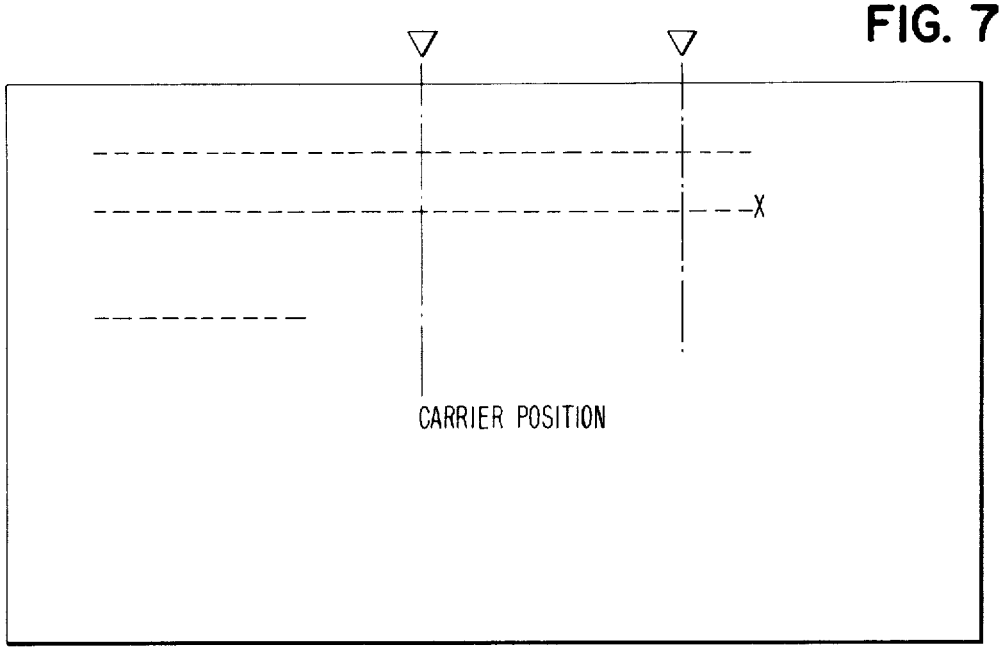
FIG. 7 is a pictorial representation of the printed page after playout or printout of the first line of the first column. This corresponds to the memory shown in FIG. 6.

Referring next to FIG. 7 there is shown a pictorial representation of the printed page after printout of the first line of the first column. The operation flag is following the carrier return on the first line of the first column. In this event the carrier, due to having been escaped through a tabbing operation upon detection of the carrier return code, will be positioned at the tab 1 position.

Figure 9:
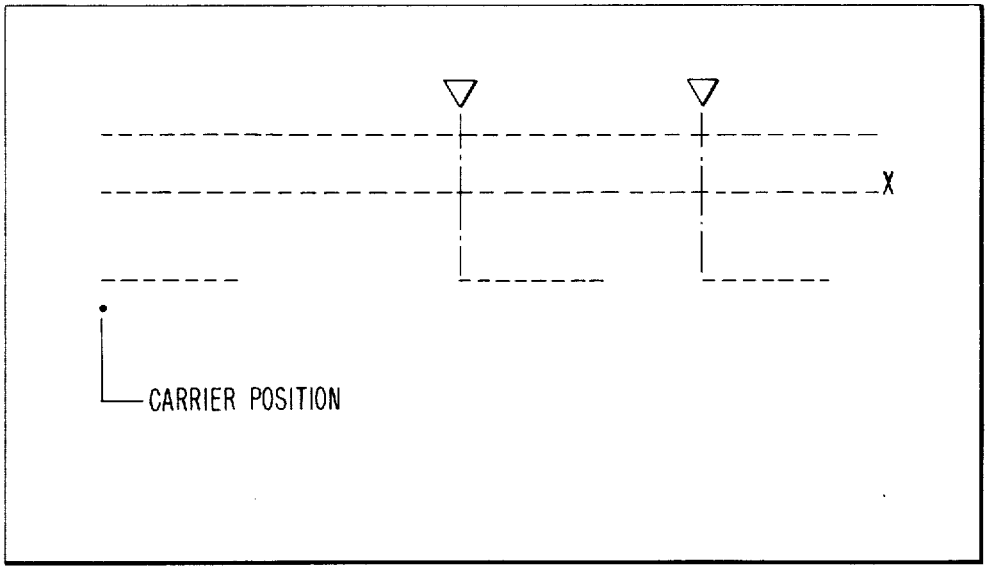
FIG. 9 is a pictorial representation of output printing of the page after playout of the first line of the last column. This corresponds to the memory in FIG. 8.
Figure 8:
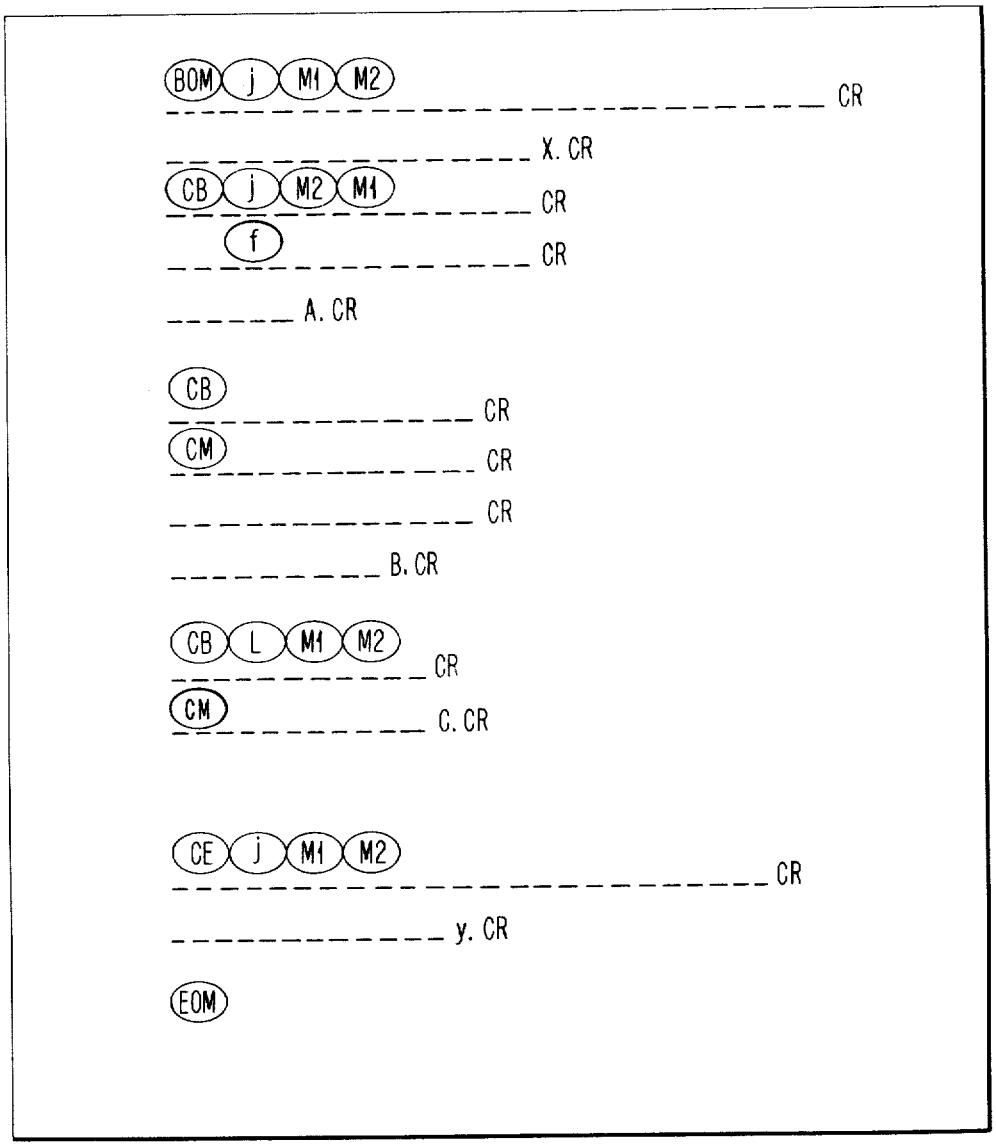
FIG. 8 is a pictorial representation of the memory after playout of the first line in the last column.

Following printout of the first line of the last column, the operation flag will follow the carrier return and a column marker code is substituted therefore. Upon the next column advance, the operation flag is effectively advanced to the beginning of the second line of the first column and substituted for the column marker code. In actuality, a column marker is written over the operation flag and a new operation flag is written over the next column marker. Therefore, FIG. 8 is an illustration of the memory arrangement following the printout of the first line of the last column and a column advance to the second line of the first column. The carrier will be positioned as shown in FIG. 9.

Figure 12:
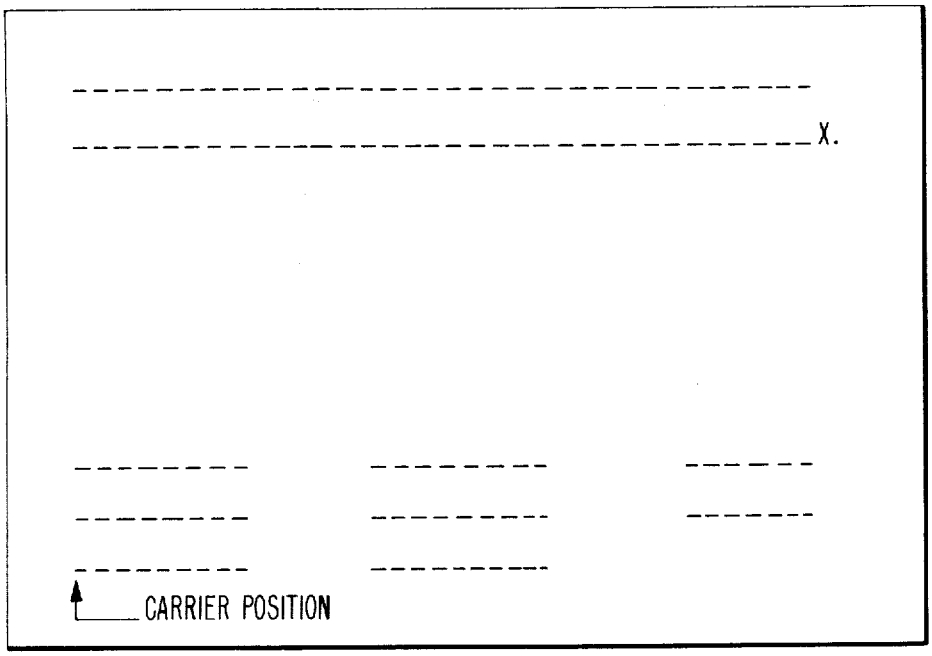
FIG. 12 is a pictorial representation of the printed page corresponding to the memory shown in FIG. 11.
Figure 10:
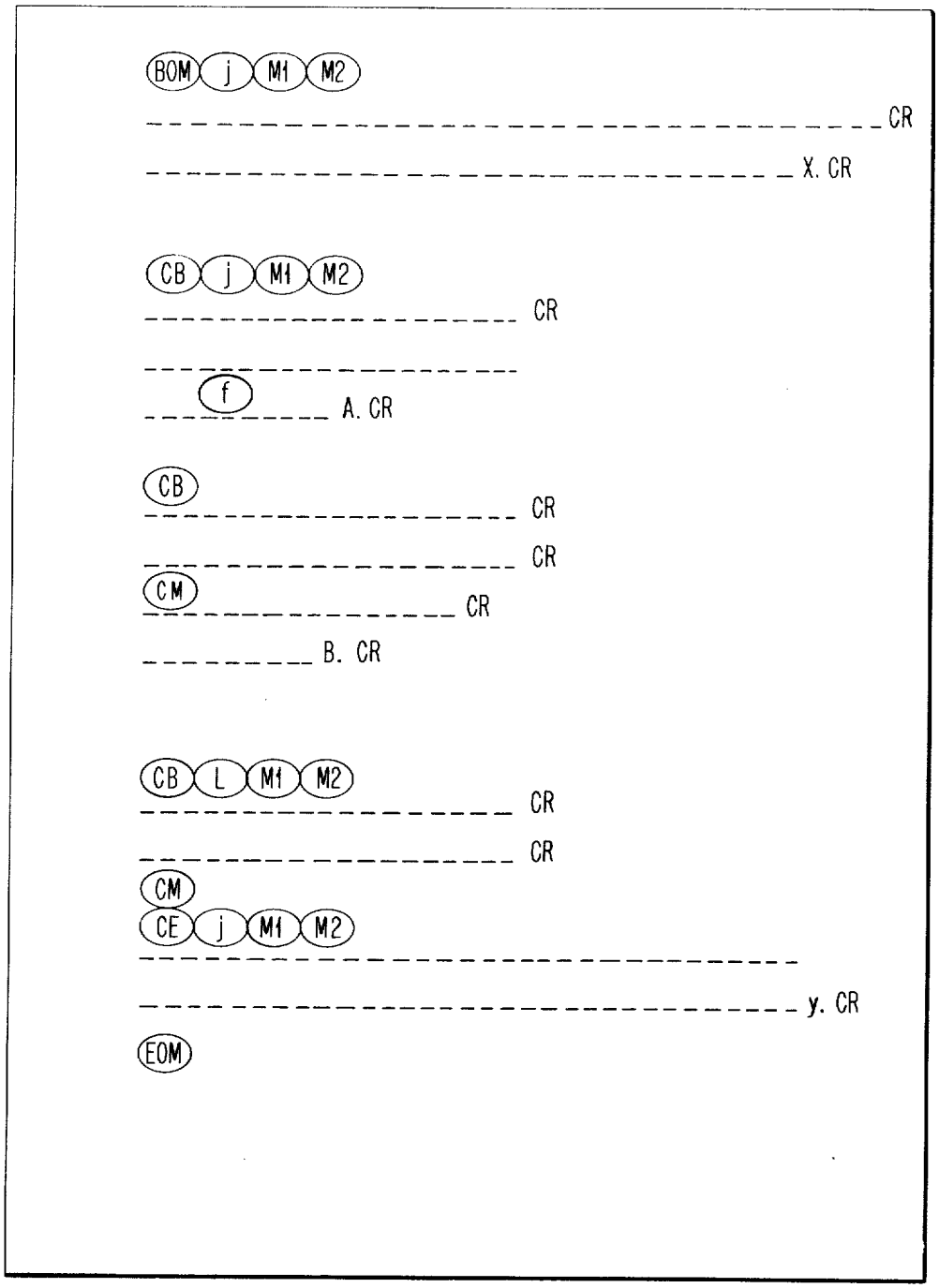
FIG. 10 is a pictorial representation of the memory following printout of the first two lines of every column.
Figure 11:
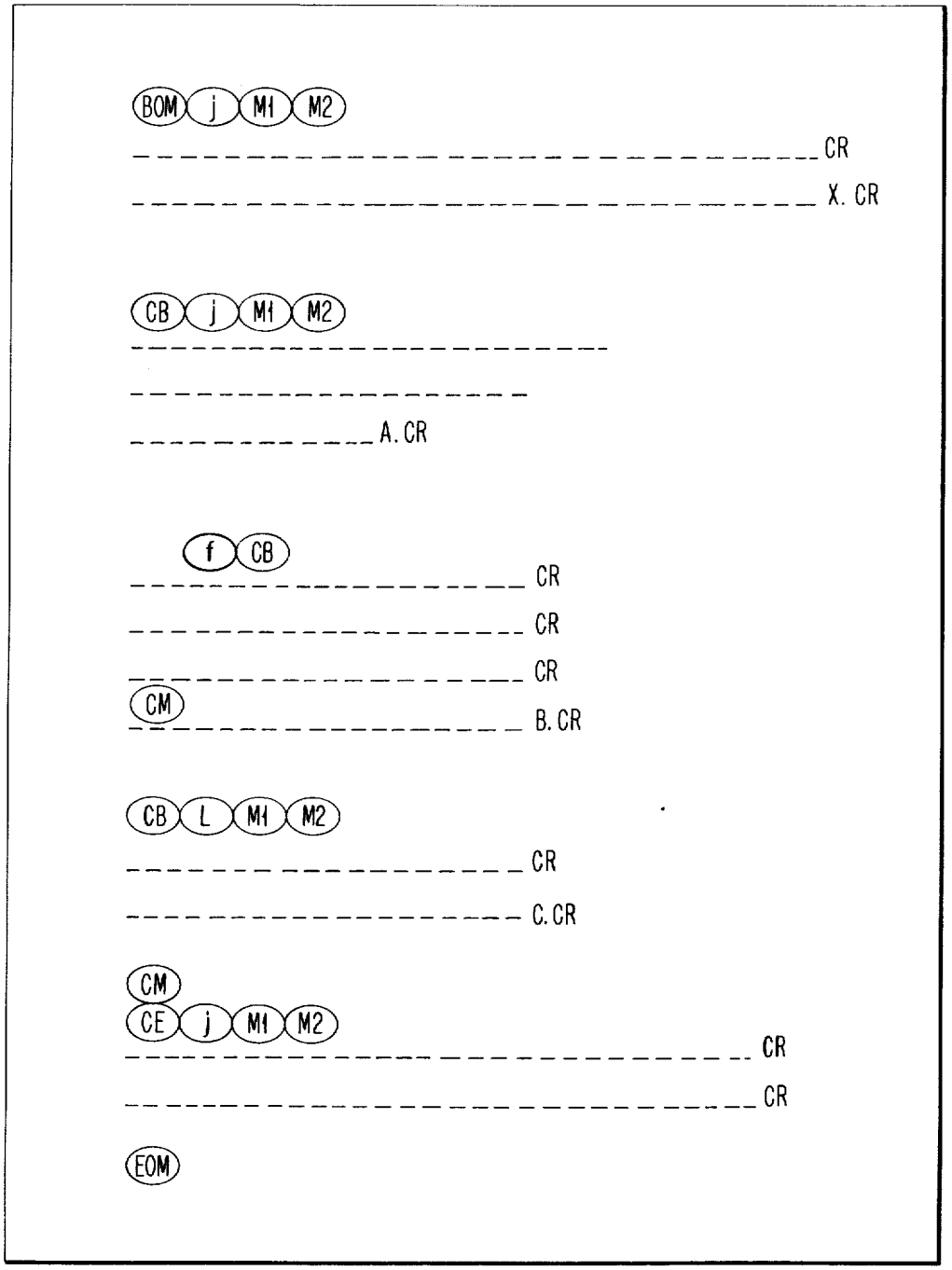
FIG. 11 is a pictorial representation of the memory prior to a column advance to the fourth line of the second column.

Refer next to FIG. 10. For a column advance from the last column to the first column, the operation flag is written over with a column marker code following the last line of the last column. A new operation flag is then written over the column marker code at the beginning of the last line of the first column. When the column marker code in the third column in memory is adjacent to the column end code, this will indicate that the last column is empty. At this particular point in time, the first two lines of every column have been printed and the memory organization is as illustrated in FIG. 10. Column marker codes are addressing the third line of the first two columns. The column marker in the third column is adjacent the column end, indicating that the column is empty. The flag is now at the beginning of the third line in column 1. The playout, mode measure scan, format scan, and column advance sequence is repeated for the third lines of each of the first two columns. After a column advance from the second column, the operation flag will be adjacent to the column end code. The detection of the column end code following the operation flag will cause the column marker code to be ignored. The operation flag will be advanced to the first column. Since the first column does not contain four lines, another column advance is performed. With the operation flag addressing the column begin codes as illustrated in FIG. 11, the carrier will be positioned as shown in FIG. 12. As pointed out, the first column has no more data to be printed, but the second column does. With this being the case, tabs are output to the printer and the carrier is caused to escape to the position at the beginning of the second column for the beginning of printout of the fourth line of the second column. At this time a new operation flag is written over the column marker and printout continues.

During the issuance of tabs to the printer for a vacant line in the first column, an additional tab must be added to position the carrier at the beginning of the second column. In memory the operation flag is advanced to this point.

Again, it is to be noted that when a column marker code is addressing or preceding a column being code, an operation flag is not written over the column marker code. When the operation flag is advanced, during printing, to the carrier return for the fourth line of the second column, a tab is output to the printer for causing the carrier to move to the beginning of the printing position for the fourth line of the third column. In memory a column advance is performed. Since the third column does not contain a fourth line as indicated by the column marker addressing the column end code, the flag is advanced to column 1 and a carrier return is output to the printer. At this time all lines of the columns have been printed and the flag is adjacent to the column begin code in the first column. Another attempt is made to print out data from column 1. However, column 1 contains no more data. Column 2 also contains no more data as is the case with column 3. With this being the case, a column marker delete operation is in order. A carrier return is issued to the printer and a column marker delete operation is initiated. In this sequence, each column marker code detected is deleted from memory. During this operation the flag is advanced and eventually is located beyond the column end code. Further, the flag will be addressing the justification code on the next to last line of the page. Upon détection of the justification code for the last paragraph which is made up of the last two lines illustrated, a scan is performed from the flag to form a justification solution for the line. When the flag addresses the last carrier return or a carrier return is issued to the printer and the flag is addressing the end of memory, the operation is terminated and the playout mode is reset.

Having briefly described above the operations to be performed, a detailed description of the structure for performing these operations is set out below.

GENERALIZED DESCRIPTION

Figure 13:
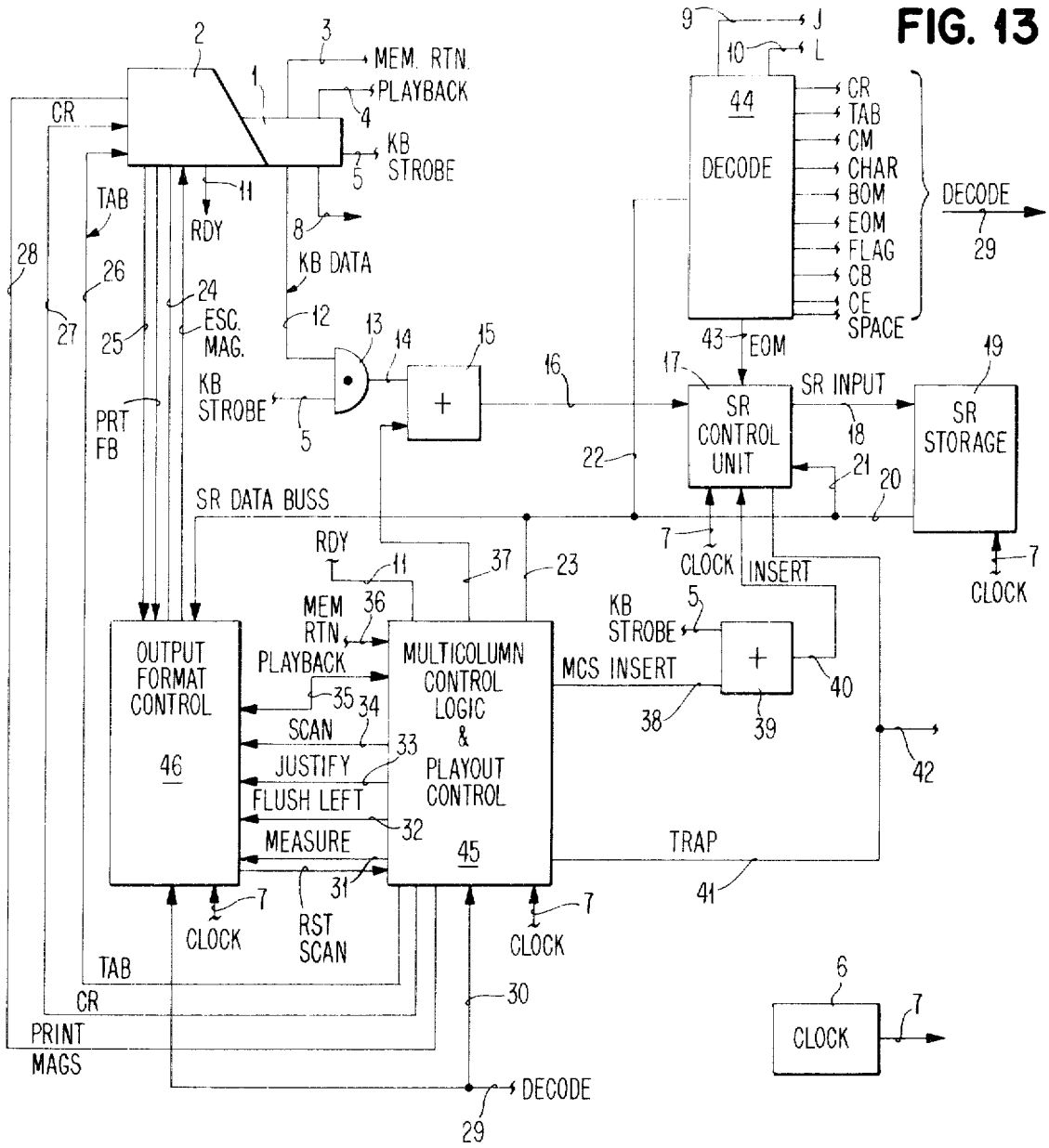
FIG. 13 is an overall block diagram illustrating the structure according to this invention for accomplishing the side-by-side printout of columns.

Referring next to FIG. 13 there is shown a keyboard 1 and a printer 2. The output of keyboard 1 is along the memory return line 3, the playback line 4, the keyboard strobe line 5, and the keyboard data line 12. An output along keyboard strobe line 5 is a timing signal indicating the presence of a character on keyboard data line 12. Although line 12 has been represented as a single line, it is to be appreciated that it is representative of a number of lines capable of carrying bits making up a character byte. Data which is keyed on keyboard 1 and appears on data line 12 is applied to AND gate 13. Upon the occurrence of keyboard strobe along line 5, the data is gated through AND gate 13 and along line 14 to OR gate 15. The data is then output along line 16 to the shift register control unit 17. Shift register control unit 17 can be equivalent to that described in U.S. Pat. Nos. 3,675,216 and 3,775,784 and U.S. patent application Ser. No. 427,184. Data input to shift register control unit 17 along line 16 is then output along the shift register input line 18 to shift register 19 for storage. The system of the shift register control unit 17, the shift register 19, the output format control 46, and multi-column control logic and playout control 45 is provided by the output of clock 6 along line 7. The data input into the shift register 19 along line 18 circulates out of shift register 19 back into the shift register control unit 17 along lines 20 and 21. The data circulating out of shift register 19 is also applied along the shift register data buss 20 and along line 23 to multi-column control logic and playout control 45. The data appearing on the shift register data buss 20 is also applied to the output format control 46. Further, the data appearing on the shift register data buss is applied along line 22 to decode 44. It is to be appreciated that as far as the input to the shift register is concerned, all inputs are considered data. This will include the mode codes as well as other control codes and characters. As far as the distinction between system generated codes and keyboard generated codes and the decode thereof is concerned, reference is made to U.S. patent application Ser. Nos. 427,184, 427,756, 427,616 and 463,028. The output of decode 44 is a justify signal along line 9, a flush left signal along line 10, and other character and control codes along decode line 29. For example, if a flag code is defined by all one's, the signal output flag along line 29 will come up when the signals along line 22 from the shift register data buss are all one's.

Printer 2 has a ready output along line 11 which comes up when, for example, the printer is idle and ready for printing a character. This signal is applied to multi-column control logic 45. Logic 45 has output lines such as line 28 connected to print magnets of printer 2. Other outputs from logic 45 include a carrier return line 27 for causing the printer to perform a carrier return operation and a tab line 26 for causing the printer to escape.

Shift register control unit 17 and shift register 19 together provide a subsystem which allows for the insertion of data and the rearrangement of control codes and characters within the memory. As pointed out above, shift register control unit 17 and shift register 19 and the interrelationship therebetween has been shown in previously filed applications. The interrelationship between the shift register control unit 17 and the shift register 19 will be briefly described below primarily as related to the unique codes applicable to this invention.

SHIFT REGISTER CONTROL AND SHIFT REGISTER

The functions of the shift register control and shift register subsystem are to provide means of inserting data into the shift register, rearranging data within the shift register, and means for maintaining and recirculating data in the shift register. The system clock 6 having an output line 7 is also used for controlling the structure set out in FIG. 14. This clock has been again shown in FIG. 14 and designated by reference numeral 47. In fact it could be a separate clock synchronized with clock 6. The output of this clock 47 provides an input to the shift register 19 along lines 64 and 66, to the N register 68 along line 65, to the E register along lines 64 and 67, and to the O register along line 64. The N register is designated by reference numeral 68, the E register is designated by reference numeral 69, and the O register is designated by reference numeral 70. All data transfers occur on the clock signal. The normal mode of operation for the subsystem made up of the shift register and shift register control is for data to circulate out of shift register 19 along n lines 49 which is the shift register data buss. This data is input to AND gate 51. Since the signal NOT trap D is normally up, the data on the shift register data buss 49 will be gated through AND gate 51 and along line 53 to OR gate 54. The output of OR gate 54 is along line 55 to the N register 68. The NOT trap D input to AND gate 51 is along line 52. Characters appearing at the output of latch register (N register) 68 normally shift along lines 57 and 58 to AND gate 76. This data is gated through AND gate 76 and along line 74 to OR gate 86 since the signals NOT expand path along line 73, NOT trap D along line 52, and NOT write along line 75 are normally true. The output of data from OR gate 86 is along line 93 to latch register 70. The letters N in register 68, E in register 69 and O in register 70 denote normal, expand, and output, respectively. The output of the output register 70 is along line 72 back into the shift register 19. The path thus described is termed the normal path. It is to be noted that characters appearing at the output of the normal register 68 are also shifted into the expand register 69 along line 57 in all cases. However, the data in the expand register is not normally used.

When a character is to be inserted into shift register 19 it is applied along line 80 to latch register 81. The data in block 79 represents a data source which can be from keyboard 1 in FIG. 13. At this time an external insert signal 94 is applied along the set line 95 to latch register 81. The insert block 94 can be obtained from an external source. With latch register 81 being set, the data impressed upon the data buss 80 is gated into latch register 81. The same source although separately represented by insert block 106 is applied along the set line 107 to latch register 108. When latch register 108 is set, an output is applied along the insert wait line 109. Latch register 108 is clock controlled along line 110 from clock 47. At this time, data will be shifting along the normal data path described above and the data to be inserted will be loaded into latch register 81. For a character to be inserted into memory following the operation flag, characters in the shift register 19 continue to shift along the normal data path until the operation flag appears in the input or normal register 68. The operation flag being shifted along line 55 into register 68 is also shifted along line 60 into decode 77. Therefore, at the time that the flag is inserted into register 68, it is decoded by decode 77 and a flag n output is applied along line 78. The flag n signal appearing on line 78 is applied to AND gate 100. Since the other input to AND gate 100 is the insert wait signal applied along lines 109 and 99, the conditions are met for gating a signal along the write line 87. The write signal applied along line 87 is also applied to AND gate 88. This will permit the contents of latch register 81 to be applied along line 82 and gated through AND gate 88. The output of AND gate 88 is along line 89, through OR gate 86, and along line 93 to the output register 70. The write signal applied along line 87 is also applied along line 101 and inverted along line 102. Therefore, a NOT write signal is applied along line 102. The NOT write signal appearing on line 102 is also applied along line 75 to AND gate 76 to inhibit the gating of the flag through OR gate 86.

At this time the character which is desired to be inserted into the normal data path and data flow is gated from latch register 81, through AND gate 88, through OR gate 86 and into the output register 70. The operation flag is inhibited at AND gate 76. But, each character input to the normal register 68 is also input into the expand register 69. Therefore, the flag is input along line 57 to the expand register 69.

At the time that the operation flag is stored in the expand register 69, the write signal is applied along the set line 87 to latch 122. When latch 122 is set, an expand path signal is applied along line 83. On the same clock pulse that the data character is gated into the output register 70, the operation flag is gated into the expand register 69. This is when the expand latch 122 is set. Thereafter, characters and codes appearing at the output of the expand register 69 are applied along line 71 to AND gate 84. With the expand path signal along line 83 being up, the characters and codes from the expand register are gated through AND gate 84 and along line 85 to OR gate 86. From OR gate 86 a character is gated along line 93 to the output register 70. A NOT expand path signal is applied along line 73 from latch 122 upon the resetting of latch 122. This is applied to AND gate 76 to inhibit the gating of characters along lines 74 and 93 from the normal register to the output register. As long as a positive signal appears on the expand path line 83, the flow of characters is from the shift register 19 to the normal register 68, to the expand register 69, to AND gate 84, and to the output register 70. This data path remains active until an end-of-memory code is decoded by decode 44. When an end-of-memory code appears on the shift register data buss, it is output along line 43 in FIG. 13 to shift register control unit 17. The input to the logic shown in FIG. 14 of this end-of-memory code is represented by block 111. The end-of-memory code 111 is applied along line 112 to delay or shift register 113. The output of delay 113 is along line 114 to delay or shift register 115. The output of delay 115 is along line 116 to delay or shift register 117. The output of delay 117 is an EOM D3 signal applied along line 103 which represents the end of memory delayed three bit times. After a delay of three bit times the end-of-memory character will be in the output register 70. The EOM D3 signal is applied along with the expand path signal along lines 103 and 83 to AND gate 104. The output of AND gate 104 is along the reset line 105 to latch 108. The EOM D3 signal along line 103 is also applied along the reset line to latch 122. When latch 122 has been reset a NOT expand path signal is applied along line 73. This causes restoration of the normal data path. This is essentially the same in terms of structure and operation as is described in the above-referenced applications and patents.

Another operation in addition to the insert operation above described will be labeled "trap". This is described below with reference to FIG. 14. The trap function or operation is to permit the rearrangement of characters within the shift register 19. An example of an operation where the trap function would be useful would be a paragraph advance operation. This type of operation has been fully described in U.S. patent application Ser. No. 427,756. With characters shifting along the normal data path and a paragraph advance operation being in order, the operator will key such an operation on keyboard 1. A trap signal will be applied along line 97. The trap block designated by reference numeral 96 represents this. Since the object is to move the flag in memory from its present position to the beginning of the next paragraph, the contents of the shift register data buss are decoded until the flag is decoded by decode 44 in FIG. 13. The output of decode 44 along line 29 results in the trap signal along line 97. With the trap signal appearing along the set line to latch 98 an output is applied along line 61; being a trap D signal. During the clock time when the trap D signal comes up, the flag is gated into the normal register 68. At this time the trap D signal is applied along line 61 to AND gate 62. The other input to AND gate 62 is the output of the normal register 68. Another output of latch or shift register 98 is the NOT trap D signal applied along line 52. This is applied to AND gate 51. As long as the trap D signal is high, the data appearing in the normal register 68 is gated back into the input maintaining the operation flag trapped in the normal register. The trap D signal along line 61 is also applied to the input of AND gate 91 along with the shift register data applied along line 50 from the data buss 49 to shift register data block 48. From block 48 the shift register data is applied along line 90 to AND gate 91. Data appearing at the output of shift register 19 is thereby gated through AND gate 91, along line 92, through OR gate 86, and along line 93 to output register 70. The above-described conditions will be maintained as long as the trap output of register 98 remains high along line 61. This signal along line 61 is to remain high until a double or required carrier return code is decoded by decode 44 and an output applied along line 29. Upon the decode of a double carrier return code along line 29 to latch register 98, the output of latch register 98 will be along the NOT trap D line 52 one bit time later. At this time the carrier return code would have already been clocked into the output register 70 and the normal data path will be restored. On the next clock time the flag which is being held in the normal register 68 will be gated into the output register behind the carrier return code. The character following the carrier return code will be gated through AND gate 51, OR gate 54, and into the normal register 68.

The above example of moving the operation flag in memory to a position behind the carrier return is merely an example of the operations to be performed. The same can be said of the insert operation. As pointed above, the above-mentioned applications are only illustrative of the insertion, deletion, and general memory rearrangement operations which can be performed.

Figure 14:
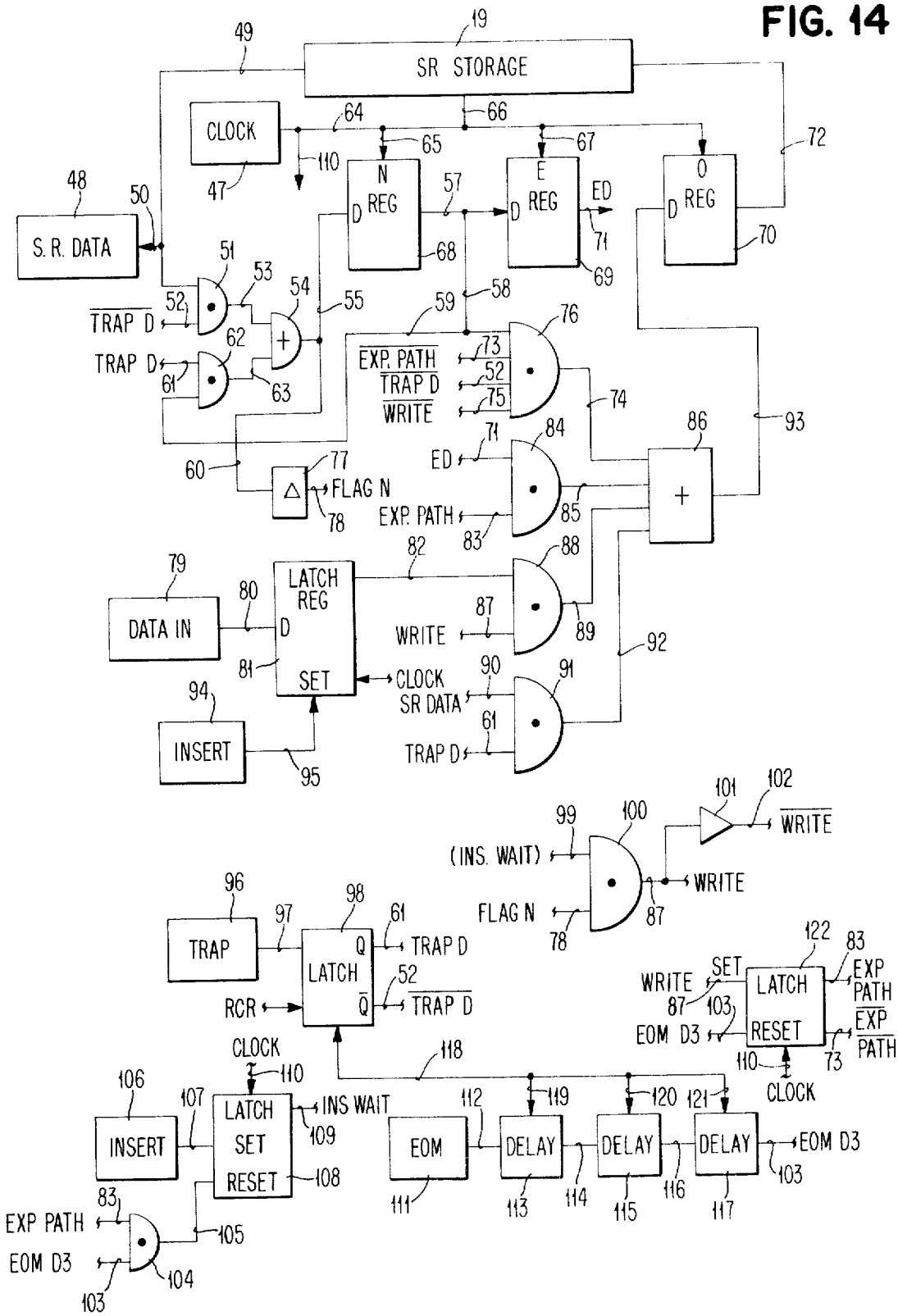
FIG. 14 illustrates in more detail additional structure to be connected to that illustrated in FIG. 13.

Referring again to FIG. 13, it is to be assumed that the shift register is initially loaded with a beginning of memory code and followed in order by an operation flag, and an end-of-memory code. Upon the keying of data by the operator the data is stored in the shift register through an insertion operation as above described. The keyboard data appears on line 12 and for each character keyed a keyboard strobe signal is applied along line 5. This causes the data appearing on the data buss 12 to be gated through AND gate 13 and along line 14 to OR gate 15. The keyboard strobe signal applied along line 5 is also applied to OR gate 39. The output of OR gate 39 is an insert signal applied along line 40 to the shift register control 17. Each character keyed is therefore inserted into the memory between the beginning of memory code and the end-of-memory code. For playback of a page stored in memory, the operator will depress a memory return button and a signal will be applied along line 3 from keyboard 1. This signal is also applied along line 36 to multi-column control logic and playout control 45. The trap signal represented by block 96 in FIG. 14 is output by logic 45 along lines 41 and 42. This can be for repositioning the flag code immediately after the beginning of memory code for a playout operation. Thereafter, the operator will depress the playback button and a playback signal will be applied along line 4 from keyboard 1. This signal is applied to both logic 45 and output format control 46 along line 35. When the flag appears on shift register data buss and at decode 44, the trap signal is brought up for one bit time and then allowed to drop. This causes the advancing of the flag one position in memory. Also, logic 45 will gate the data on the shift register data buss into an internal storage register on the bit time following the occurrence of the flag code on the shift register buss. When the ready condition is received along line 11 from printer 2, a character will be printed due to the signal applied along the print magnet line 28 to printer 2. The character following the operation flag will then be printed. The above operation is repeated for each character with the operation flag being advanced toward the end of memory. When a space is detected in the data flow, the flag is advanced in the normal manner. However, output format control 46 will output a space to printer 2 along line 24 and control escapement through the counting of emitter pulses applied from printer 2 to output format control 46 along line 25. Output format control 46, which will be described in more detail later in the specification, as will multi-column control logic and playout control 45, is designed to control the output format. It receives mode commands from logic 45 such as scan along line 34, justify along line 33, flush left along line 32, and measure along line 31. Further, it continuouslu monitors the shift register data buss and decodes from decode 44. Output format control 46 further has the capability to scan the data appearing on the shift register data buss 20 and to calculate solutions such as justification solutions when a justify command is issued along line 33 from control 45. It is therefore the function of control 46 to continuously monitor output and provide the correct value for any space outputted according to the mode supplied by control 45, and measure data supplied by control 45.

Control 45 contains storage facilities such as random access memories wherein the mode code is stored whenever the flag is advanced beyond a mode code. Control 45 also contains storage for the two binarily weighted measure codes or pairs which follow every mode code. Again, random access memories can be used for this which have an included memory address register and counter.

Referring again to FIG. 2, it will be noted that when playout begins the flag will be addressing the justify mode code and this will be stored in lgoic 45. Also, the two measure pairs M1 and M2 following the justify code will be stored in appropriate storage facilities in logic 45. This data will be output to control 46 continuously. Control 46 will in turn scan the data following the measure codes to form a justification solution and on each space, will control the space magnet and escapement in printer 2 in order to correctly form a justified line.

In normal operation, each time the operation flag addresses a carrier return code, logic 45 will output a carrier return along the carrier return line 27 to printer 2. At this time control 46 will scan the next line to prepare a justification solution. This operation will continue until the operation flag addresses the first column begin code and the memory is as illustrated in FIG. 3. At this point the printed page will appear as illustrated in FIG. 4. The functional operation of the system has been briefly described above with reference to FIGS. 1–12.

SET UP OF COLUMN MARKERS

As pointed out above, logic 45 continuously monitors the output of decode 44 which appears along lines 29 and 30. When a column begin code is detected following the operation flag, a column marker code is generated and output along line 37 to OR gate 15. The signal MCS insert along line 38 is applied to OR gate 39. The is applied at the proper time to cause insertion of the column marker code into shift register 19 following the second column begin code.

Following the insertion of the column marker code in the memory following the second column begin code, a scan is performed to locate the next column begin code following the flag. Upon detection of the column begin code another column marker code is inserted in the memory. This is repeated for each column begin code found in memory between the operation flag and the column end code.

Before all column marker codes have been inserted in the memory a trap signal was generated by logic 45 along lines 41 and 42. This is for repositioning the operation flag in memory and locating it at a position beyond the first column begin code as illustrated in FIG. 5. FIG. 5 illustrates the memory arrangement after insertion of the column markers.

MODE MEASURE SCAN

The next operation involves temporarily suspending printout while logic 45 scans the data in the shift register appearing on line 23 and the output of decode 44 along liines 29 and 30. When the justify mode code is detected it is stored in an internal register such as a random access memory as are the measure pairs. Each succeeding mode code and measure pair will be written over the preceding mode and measure pairs in the internal storage of logic 45. This information is then output along lines 31–34 to control 46. For the memory arrangement illustrated in FIG. 5 the mode and measure stored within logic 45 would consist of the mode and measure following the beginning of memory.

SCAN

Again referring to FIG. 5 and assuming a playback signal appearing on line 4 from keyboard 1, logic 45 will generate a signal on the scan line 34 to control 46. Thereafter, control 46 will scan the memory from the flag to the next carrier return code and form a justification solution.

FLAG ADVANCE

For continued operation in the playout mode the operation flag is advanced just beyond the justification code. Logic 45 is loaded with the justification code and it is stored therein. Then the flag is advanced beyond the measure pair and logic 45 will generate another scan pulse along line 34 to control 46. The scan performed under the description labeled scan above would not result in a justification solution since the mode and measure pair stored would be for the preceding text and there is a substantial difference in the measures. Following the storage of the mode and measure pairs shown in column 1 of FIG. 5, another scan is generated and a pulse applied along line 34 to output control 46. At this time the data between the flag and the next carrier return is scanned. Control 46 then utilizes the mode and measure output from logic 45 to compute a new solution for space width based on this mode and measure.

Playout continues with the flag advancing and characters and spaces being printed as controlled by control 46. When the flag addresses the first carrier return in column 1 the carrier will be at a position corresponding to the measure of column 1 since all characters and spaces will have been output for the first line of that column. With the operation flag addressing a carrier return the flag is advanced beyond the carrier return and a tab code is output from logic 45 to printer 2 causing the printer to tab to the tab 1 position shown in FIG. 1. With the carrier at the tab 1 position, a column advance operation is performed for repositioning the operation flag at the beginning of the first line in the second column. The flag is written over the column marker code. Prior to the column advance though, a column marker code was written over the flag code at the end of the first column. At the completion of the column advance operation, the memory will appear as shown in FIG. 6. That is, the operation flag will be located in the second column and the column marker code in the first column will be addressing the second line. This will indicate that the first line has been printed out. Printout will appear as shown in FIG. 7. The above-described operation beginning with the mode measure scan above is repeated.

When the third column is encountered it is noted that new mode and measure information is stored. This is handled similarly to the justification of the previous columns with the exception that the output is flush left against the tab 2 position. In this case a minimum space will be used for printout and there will be no expansion.

When the operation flag addresses a carrier return code in the last column, a carrier return is output from logic 45 along line 27 to printer 2. This will cause a carrier return operaion to be performed by printer 2, an indexing operation to be performed by printer 2, and the column advance operation to be performed. Logic 45 is structured such that the operation flag is now written over the column marker code in column 1. This is because the operation flag originated within the last column and there are no other column marker codes before the column end code. The logic 45 is structured such that a duplicate operation flag is always written in the memory over the next column marker code following the original position of the operation flag in the forward direction. For this example, a duplicate operation flag is written in the memory over the column marker which is on the second line of column 1. The first operation in the column advance logic sequence is for the first operation flag code to be overwritten by column marker code. After this point the memory will appear as shown in FIG. 8. Note that the column marker codes are on the second lines of each column and the operation flag is within the second line of the first column. The printed page will appear as shown in FIG. 9.

EMPTY COLUMN

On a column advance out of the last column as described above a duplicate operation flag is written into memory over column marker code in the first column. The original operation flag was overwritten with a column marker code. This leaves the column marker code in column 3 adjacent the column end code. This will indicate to the system that column 3 is empty. At this point, the first two lines of every column have been printed and the memory will appear as shown in FIG. 10.

Figure 15:
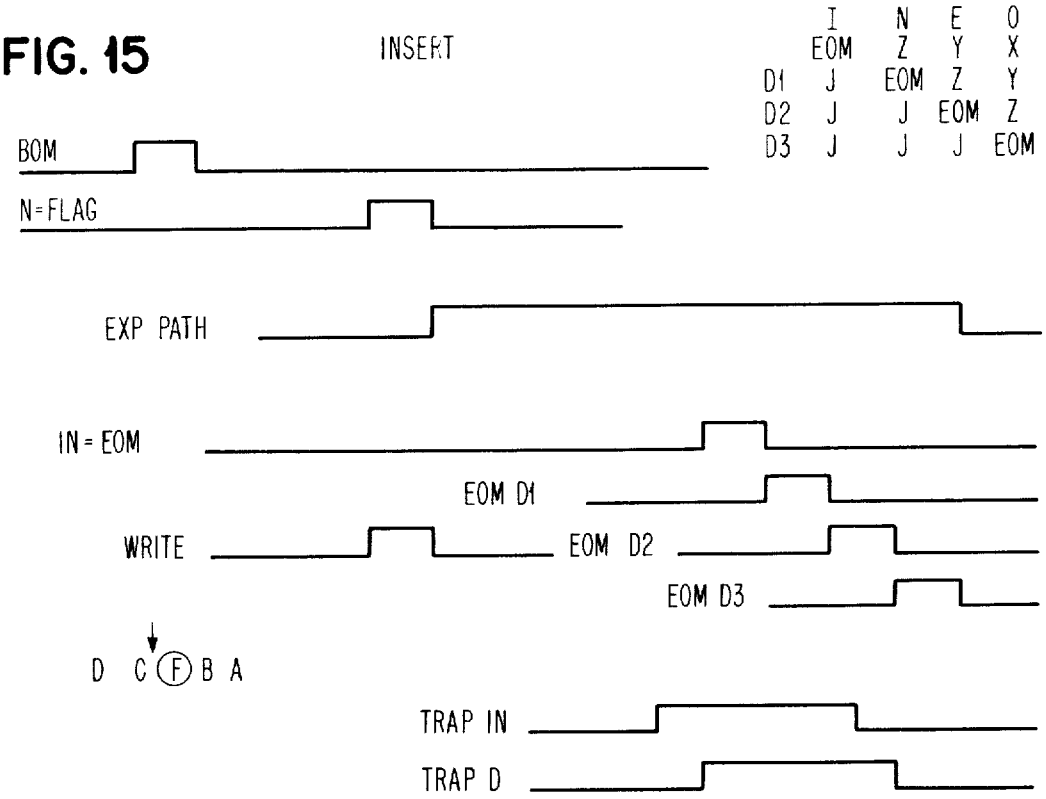
FIG. 15 is a timing diagram illustrating the timing of the operations performed in FIG. 14.

Referring next to FIG. 15 there is shown a timing diagram illustrating the timing of the operation and signals for an insert operation as described above with reference to FIG. 14. Shown are the beginning of memory (BOM), the flag and the normal register, the expand path signal, the EOM signal in the normal register, the EOM D1 signal, the write signal, the EOM D2 and the EOM D3 signals, the trap n signal, and the trap d signal.

Figure 16:
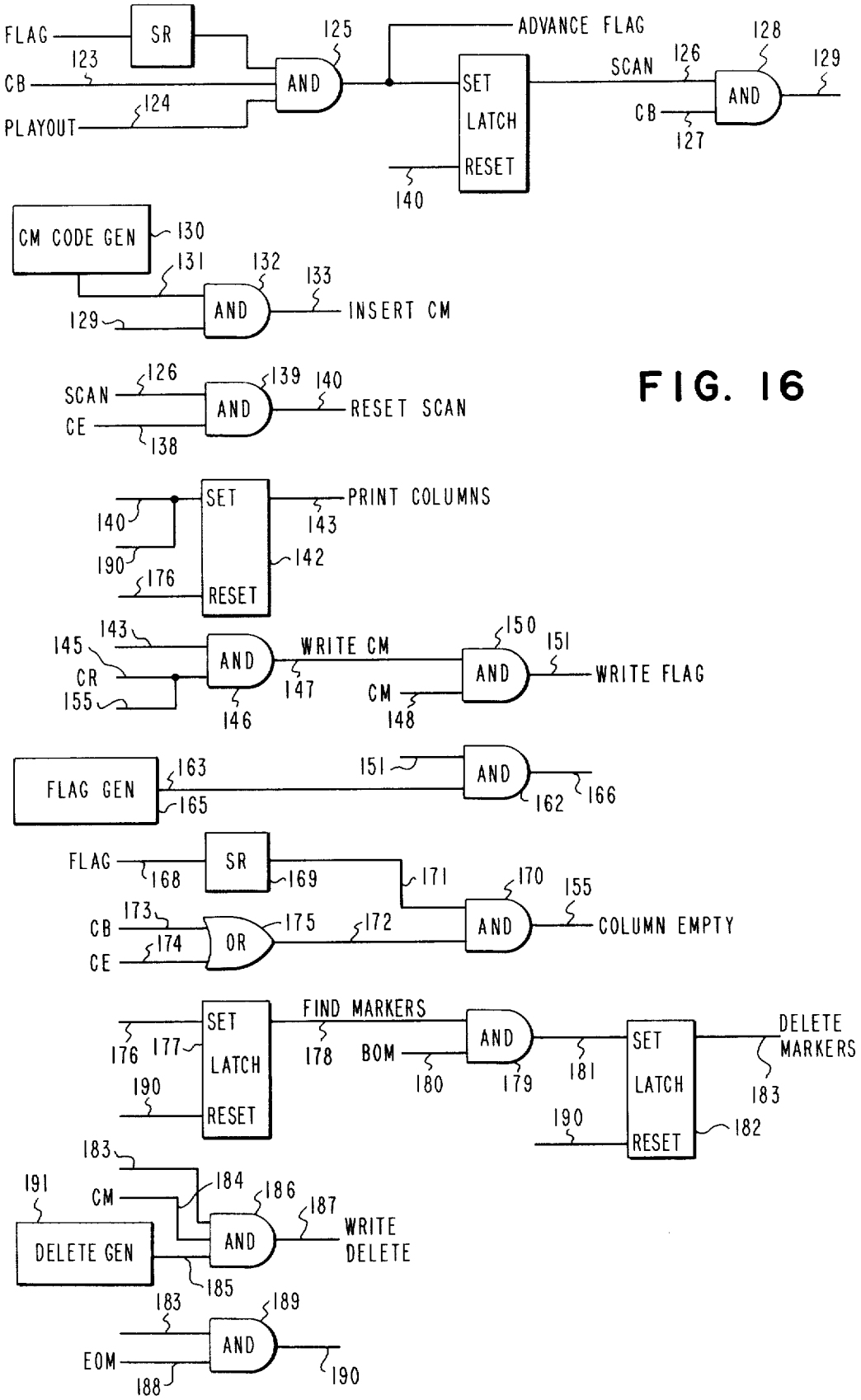
FIG. 16 illustrates in a block diagram manner the structure included in the multi-column control logic and playout control shown in FIG. 13.

Referring next to FIG. 16 there is shown in simplified form the combinational logic making up the multicolumn logic and playout control of block 45 shown in FIG. 13. A column begin code appearing at the output of decode 44 and along line 29 is applied along line 123 to AND gate 125. The other input to AND gate 125 is along lines 4 and 124 from keyboard 1. With all of these signals being up, the output from AND gate 125 is used to advance the flag and set a scan latch which provides one of the inputs to AND gate 128. The other input to AND gate 128 is the column begin code along line 29 in FIG. 13 upon detection of the second column begin codde. This is applied along line 127 to AND gate 128. The output of AND gate 128 is along line 129 to AND gate 132. The other input to AND gate 132 is from column marker code generator 130 along line 131 for gating a column marker code through AND gate 132. The output from AND gate 132 is for inserting the column marker code following the column begin code and continuing scan. The output of the scan latch is applied to AND gate 139 which will result in a reset scan signal being applied along line 140 when a column end code is detected along line 29 and applied along line 138 to AND gate 139. Reset scan signal 140 is applied to latch 142 to set it. This latch indicates that all column markers are inserted and playout is in order.

Although the output of some of the lines have been described functionally, as for example, line 133 for inserting a column marker following a column begin, it will be appreciated that this signal applied along this line can be applied to the insert logic shown in FIG. 14. Further, as pointed out above the combinational logic illustrated in FIG. 16 has been simplified for purposes of clarity. It will be appreciated by those skilled in the art that numerous latches are required for proper timing. Also for purposes of this figure it is assumed that the operation flag is addressing the first character of the first line of the first column.

Referring again to latch 142, the output thereof is applied along line 143 for causing the printing of characters and advancing the flag. This is also applied to AND gate 146. Another input to AND gate 146 is a carrier return along line 145. When a carrier return is decoded by decode 44 in FIG. 13 an up signal will be applied along line 145 and an output will be applied along line 147 for causing a column marker to be written over the operation flag. The output of AND gate 146 along line 147 is applied to AND gate 150. The other input to AND gate 150 is the column marker code for the second column. When this is detected, a signal is applied along line 148 to AND gate 150. This will cause a flag code generated by flag code generator 165 to be output along line 163 to AND gate 162. The output from AND gate 162 is along line 166 for causing flag to be written over the column marker. This also causes continuation of printing of the characters and the advancing of the operation flag. When a column begin code or column end is detected following the flag, a signal will be applied along line 155 to AND gate 146. This causes another column advance operation. Once printing is completed in each column, a signal is applied along line 176 to initiate the column marker delete operation. This signal sets the find markers latch 177 and resets the print columns latch 142.

When the beginning of memory code is detected a signal is applied along line 180 to AND gate 179 along with the output of the find markers latch 177 along line 178. The output of AND gate 179 sets delete markers latch 182 along line 181. Thereafter each time a column marker code is detected a signal is applied to AND gate 186 along line 184 along with the output of latch 182 and delete generator 191. The output of AND gate 186 along line 187 causes a delete code to be written over the column marker code. Upon detection of the end of memory the output of AND gate 189 is applied along line 190 to reset both latches 177 and 182; thereby terminating the marker cleanup operation. It also causes the flag to be advanced to a position just following the column end code and sets the print columns latch 142. FIG. 16 is therefore representative of the logic contained in block 45 of FIG. 13.

Refer next to FIGS. 17 *a–e*. Shown in these figures are the logic and timing therefor included in output format control 46 for justifying output lines. This has been simplified for purposes of clarity and it will be appreciated by those skilled in the art that the lines have been described functionally.

To begin with, character escapement is controlled through the counting of emitter pulses applied from printer 2 to output format control 46 along line 25. THe function of control 46 is to continuously monitor output and provide the correct value for any character or space escapement output according to the mode and measure supplied by control 45.

Before a line can be formatted, it is scanned and the space size solution for that line is determined. During playout printer control 45 controls the printer magnets to initiate printing while output format control 46 controls character and space escapement by counting emitters from the printer 2. Multi-column control logic and playout control 45 initiate the scan by driving scan along line 34 to output format control 46. Next refer to FIG. 17*a*. Scan 34 is applied through shift register 193 along line 194 to inverter 194. The inverted and delayed signal is applied to AND gate 197 along line 196. This signal along with scan 34 and playback 35 generate front of scan, FOS, which sets MXP latch 199. MXP latch 199 along with FINDFLAG latch 214, text scan latch 219, and RDN latch 225 define the sequence of events controlling the entire scan operation (see FIG. 17*d*). Each control latch gates one or more operations and is reset when that operation is complete, e.g. the output of MXP 199 is applied to multiplier 203 along line 202 which proceeds to form the product, the measure (half picas) line 31, and the half pica pitch constant, PCONS (units per half pica) 230. When the product is complete, multipler 203 generates the gating signal RT which is applied along line 204 to AND gate 206, to the reset gate of the MXP latch 199 and AND gate 212 along line 211. RT allows the product of measure and PCONS to be gated through gate 206 along line 207, through OR gate 208 to residue register 210. At this time FINDFLAG latch 214 is set through AND gate 212. Text scan latch 219 is set where the flag is found. Its output is applied along line 220 to AND gate 221 where it enables setting the RDN latch 225 along line 224 when a line end (LNEND) code is scanned. Text scan is applied along line 231 to AND gate 232 along with SIGCHR line 247 and space line 248. AND gate 232 gates UPCTR 250 once for each interword word space scanned on the line. Text scan is also applied along line 233 to AND gate 234. AND gate 234 generates the gating term RME for each character or space scanned. RME is applied along line 240 to subtractor 241. Subtractor 241 forms the difference between the residue register 210 applied along line 244 and the escapement decode 242 of the character being scanned. This is applied along line 243. The difference is applied along line 254 through AND gate 255, along line 256, through OR gate 208 to residue register 210. When a line end code is scanned the logic consisting of decode 257, shift register 259, AND gate 246, and PARA latch looks ahead to the next character for paragraph definition code. LNENDO is applied along line 222 to the reset gate of text scan latch 219 causing it to reset. It is also applied to AND gate 221 causing the RDN latch 225 to set.

Figure 17B:
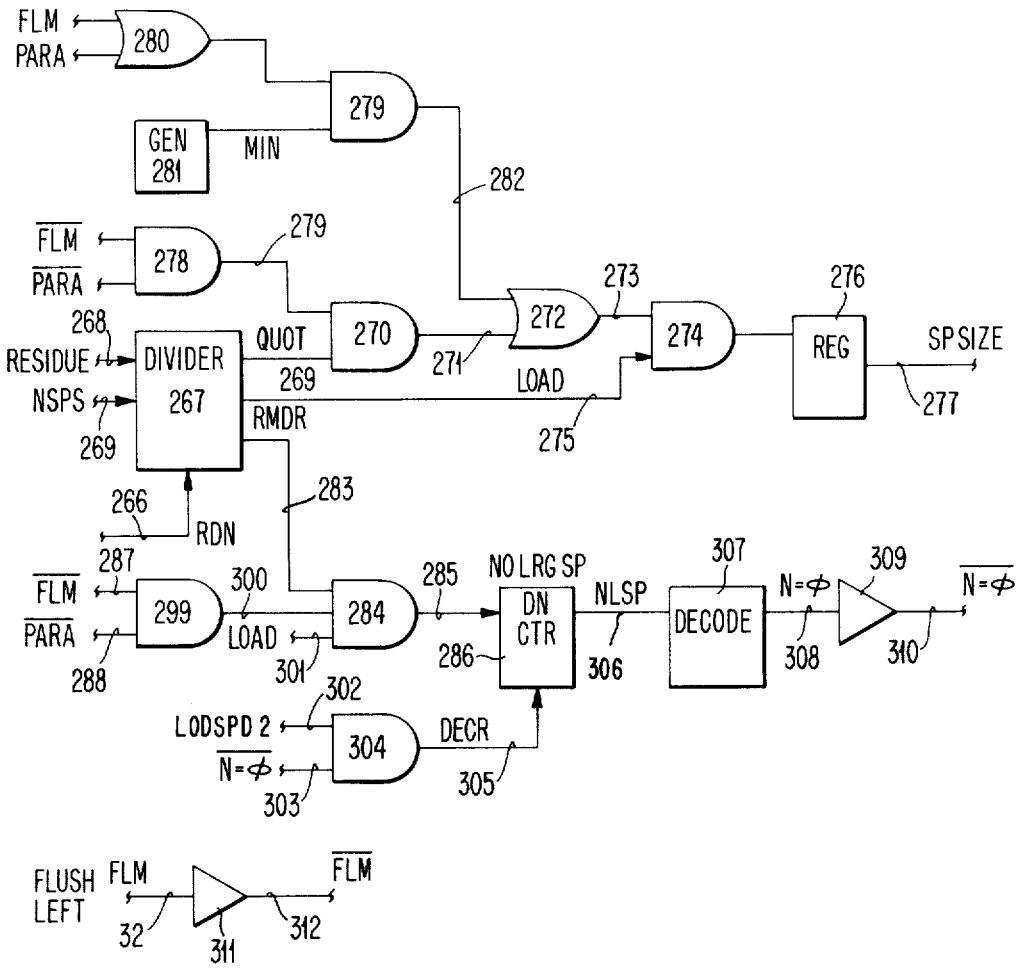
FIGS. 17 *a–c* illustrate in a block diagram manner the output format control illustrated in FIG. 13.

Next refer to FIG. 17*b*. The RDN signal is applied to divider logic 267 along line 266. RDN allows the divider to form the quotient of residue applied along line 268 and number of spaces (NSPS) applied along line 269. The divider generates the signal load when the quotient is complete which allows the quotient to be gated into the space size (SPSIZE) register 276 along line 269, AND gate 270, line 271, OR gate 272, line 273, AND gate 274. If flush left mode (FLM) is active or the line is the last line of a paragraph (PARA) the minimum space size is gated into space size register 276 via AND gate 279 along line 282 to OR gate 272. The divider 267 also forms a remainder RMDR 283 which defines the number of outputs spaces that must be larger than the solution by one unit to cause justification. This number is applied along line 283 to AND gate 284 and waded into the number of large spaces (NLSP) counter 286 if neither FLM 287 nor PARA 288 are active. NLSP 286 is decremented each time a space is outputted to the printer until the NLSP is reduced to zero due to the output of AND gate 304. The load output of the divider 267 is applied via lines 277 and 288 to RDN latch 225 and AND gate 229 respectively. It causes RDN to reset and simultaneously drives the RSTSCAN line to the multi-column control logic 45. This causes scan to reset and allows playout to proceed normally until the next line end code is processed. The end of scan (EOS) AND gate 264 causes the PARA latch 263 to reset.

Divider 267 can be readily implemented using both adder and a subtractor.

Figure 17C:
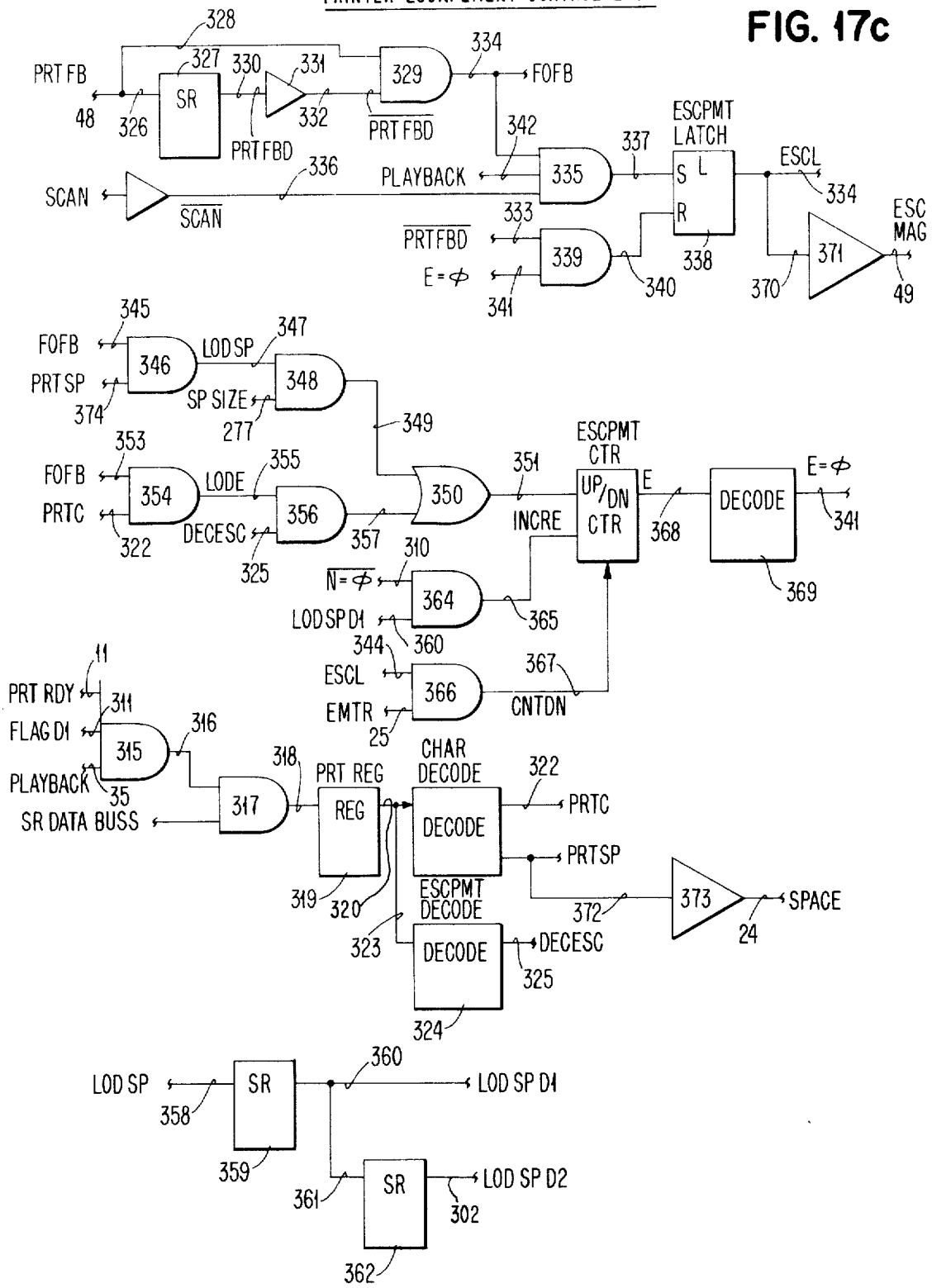
Figure 17D:
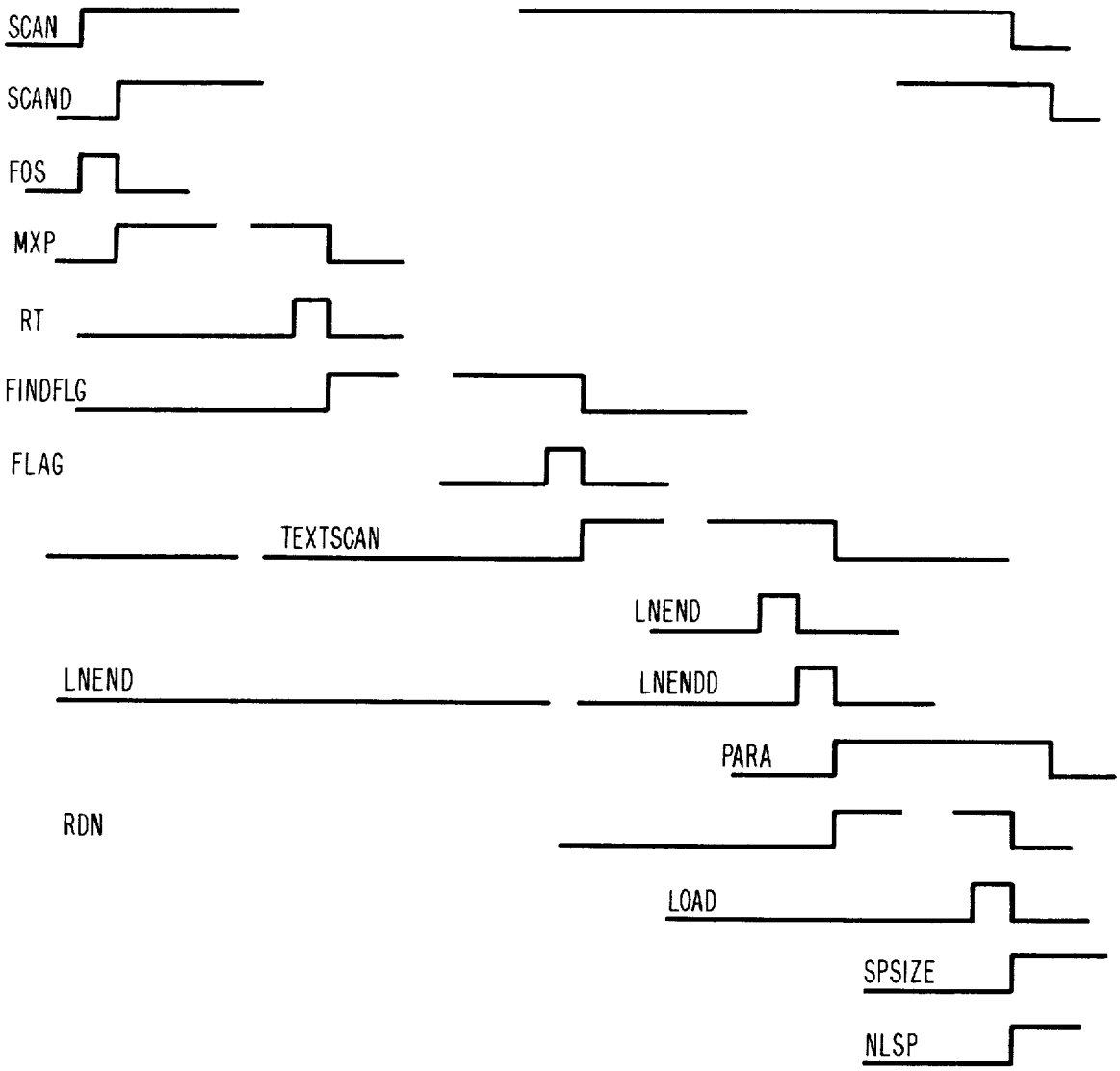
Figure 17E:
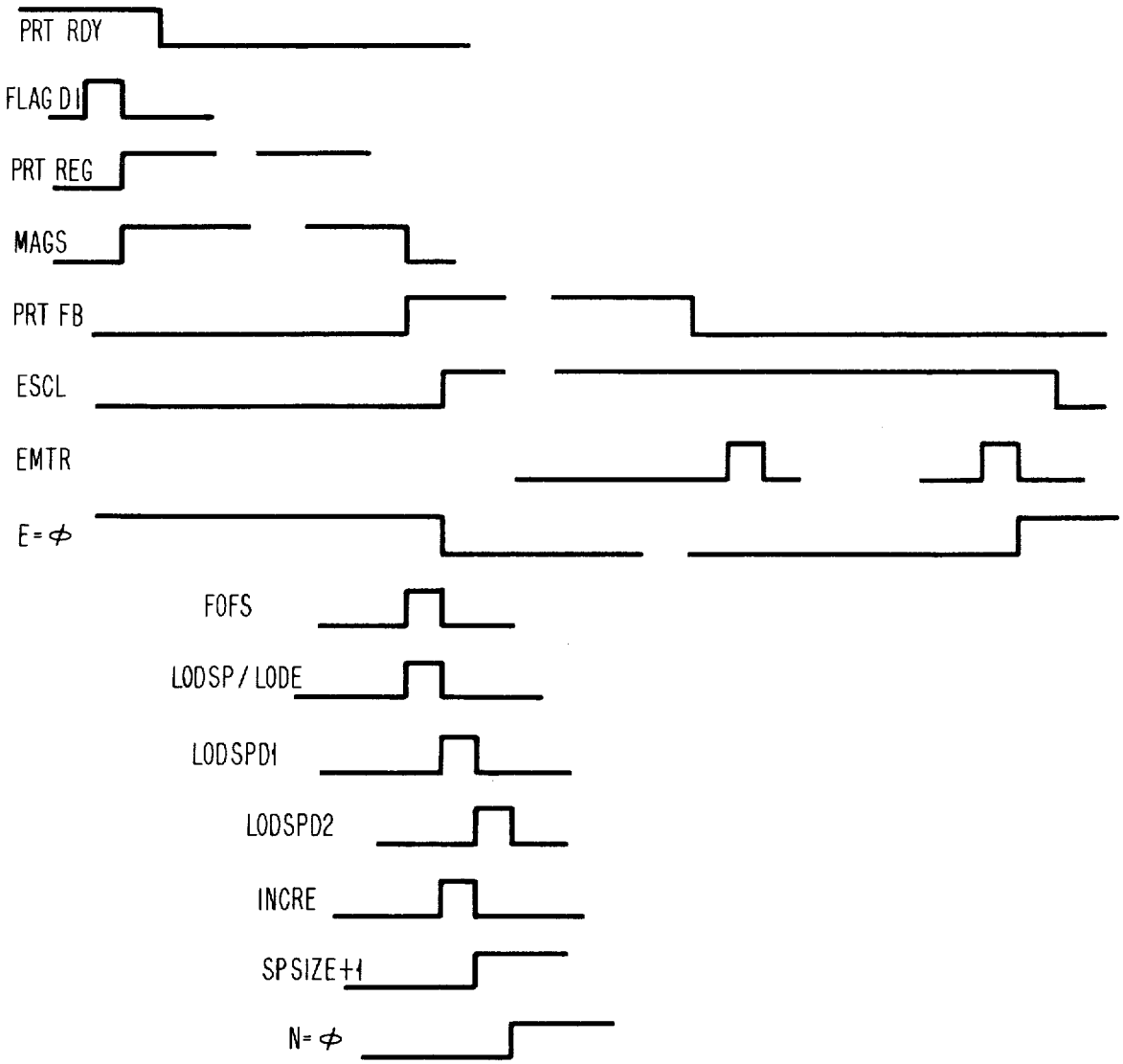

Next refer to FIGS. 17*c* and 17*e*. With playback line 35 and printer ready line 11 active, the code following the flag is gated into the printer register 319. The output of print register 317 is applied to character decode 321 where signals such as PRTC line 322 and PRTSP line 372 are generated. The output of PRTREG 319 is also applied along line 323 to the printer escapement decode 324. This logic decodes an escapement value appropriate to the character being printed. Priner feedback (PRTFB) is generated by printer 2 in FIG. 13. PRTFB initiates the character/space escapement control operation as follows. The front of feed (FOFB) signal is generated by AND gate 329 (refer also to FIG. 17*e*.). FOFB causes the escapement latch ESCL 338 to set through AND gate 335 if playback line 342 is active while scan is reset. FOFB is applied along line 345 to AND gate 346 where it is used to generate load space command (LODSP) line 347 only if the character being printed is a space code (PRTSP line 374). Under this condition the contents of the space size register 276 are gated through AND gate 348 along line 349 through OR gate 350 and into the escapement counter 352. If the character being printed is a print character, the PRTC output of the character decode 321 will be applied along line 322 to AND gate 354 causing load escapement (LODE) to be active. LODE line 355 enables AND gate 356 to gate the character escapement generated by escapement decode 324 and applied along line 325 to be loaded into the escapement counter 352 along line 357 through OR gate 350. Escapement counter 352 is an up/down counter. It is incremented for each space code outputted to the printer 2 until the number of large spaces (NLSP) counter 286 is reduced to zero. This is accomplished as follows: decode 307 detects when NLSP is equal to zero and generates the term N is equal to zero line 308 which is inverted at 309 and applied along line 310 to AND gate 364 along with LODSPD1 which is generated by shift register 359. The NLSP counter 286 is decremented for each space operation. The evaluating signal (DECR) is generated by AND gate 304 and applied to the NLSP counter along line 305. LODSPDZ is generated by shift register 362 and applied along line 302 to AND gate 304. As shown in FIG. 17*e*, the printer 2 generates emitters after printer feedback. The escapement with signal ESCL 344 enables AND gate 366 to generate the count down (CNTDN) gating time line 367 for the escapement counter 352. The state of the output of the escapement counter 352 is detected by counter decode 369 which generates E is equal to zero. E is equal to zero is applied along line 341 to AND gate 339 along with $\overline{\text{PRIFBD}}$ on line 333 to cause the escapement latch 338 to reset via line 340 and the printer 2 to stop escaping by removing the drive from mag driver 317 and along line 49 to the printer.

In summary, a system is provided having a keyboard and a printer, a buffer and control, a multi-column playout control and an output format contro. During setup for input keying, a beginning of memory code is stored, the mode to be used first is stored, and an overall measure is stored in the buffer. Also, since the input printer is the same as the output printer, a tab field is set up for defining the locations in which the columns are to be located. For columns which are to be stored sequentially, but printed out in a side-by-side manner, the beginning of each column is defined by a column being code. For the first column, this code is stored along with the column mode and measure. If subsequent columns have different modes or measures, they will be stored along with the columns concerned. Each column is then keyed and stored in its entirety. At the end of the last column to be printed out in side-by-side relationship, a column end code is keyed and stored. Upon playout from the buffer, the buffer memory is scanned when a column begin code is encountered. An operation flag is inserted into the data flow making up the buffer memory after the first column begin code. After each column begin code except the first, a column marker code is inserted and scan continues. Upon detection of the column end code, scanning continues to the beginning of memory. When the operation flag is again detected, following characters and spaces are printed out in the defined mode until a carrier return is detected. The printer is caused to tab rather than to return the carrier to the left margin. A column advance operation is then performed. This causes a column marker code to be written over the operation flag, and a scan of memory. The next detected column marker code is written over with a new operation flag. Printout then continues until a carrier return is detected. The operation described continues with column advance operations until the end of each column is reached. After printout of all columns, the column marker codes are flushed from memory.

While the invention has been particularly shown and described with reference to a particular embodiment, it will be understood by those skilled in the art that various changes in form and detail may be made without department from the spirit and scope of the invention.

What is claimed is:

1. A system for causing corresponding portions of a plurality of text columns to be printed on the same print line to form a side-by-side column format prior to causing a printer carrier return, said system comprising:

a. memory means having said text columns sequentially stored therein;

b. means for causing a marking in said memory means of (1) initial print locations in each of said text columns for defining each beginning of the first of said corresponding portions of said text columns to be printed, prior to printing, and (2) after a portion of one of said text columns has been printed, a print location defining a beginning of the next portion to be printed from said one of said text columns on a subsequent print line;

c. means for defining locations for printing each of said text columns;

d. means for causing printing, from a print location, of a portion of one of said text columns on a print line in an appropriate one of said defined locations; and e. means for causing printing, from print locations any corresponding portions from succeeding text columns on said print line in appropriate ones of said defined locations.

2. A system according to claim 1 including means for detecting said sequentially stored text columns for marking said print locations.

3. A system according to claim 2 including means for causing printer escapement along said print line for printing any subsequent corresponding portion when a carrier return is signalled.

4. A system according to claim 3 including means for causing a column advance of said stored columns when said carrier return is signalled.

5. A system according to claim 1 wherein said means for causing a marking in said memory means includes means for deleting a marking of a beginning of a portion after printing of the portion.

6. A method of causing corresponding portions of a plurality of text columns sequentially stored in a memory to be printed on the same print line to form a side-by-side column format prior to causing a printer carrier return, said method comprising:

a. causing a marking in said memory of initial print locations in each of said text columns for defining each beginning of the first of said corresponding portions of said text columns to be printed, prior to printing;

b. causing a marking in said memory of, after a portion of one of the said text columns has been printed, a print location defining a beginning of the next portion to be printed from said one of said text columns on a subsequent print line;

c. defining locations for printing each of said text columns;

d. printing, from a print location, a portion of one of said text columns on a print line in an appropriate one of said defined locations; and e. printing any corresponding portions, from print locations, from succeeding text columns on said print line in appropriate ones of said defined locations.

7. A method according to claim 6 including detecting said sequentially stored columns.

8. A method according to claim 7 including escaping said printer along said print line for printing any subsequent corresponding portion when a carrier return is signalled.

9. A method according to claim 8 including advancing to another column when a carrier return is signalled.

10. A method according to claim 6 including deleting a marking of a beginning of a portion after printing of the portion.

11. A method according to claim 10 including marking the beginning of each of said text columns and the end of the last of said text columns during storing of said text columns in said memory.

* * * * *